US007637567B2

(12) United States Patent
Neustat et al.

(10) Patent No.: US 7,637,567 B2
(45) Date of Patent: Dec. 29, 2009

(54) ADJUSTABLE SLIP COVER FOR SOFAS

(75) Inventors: Paula S. Neustat, New city, NY (US); Brenda Kay Miller, Jersey Shore, PA (US); Walter Garbinski, Kutztown, PA (US); Ann Elizabeth Shields, Allentown, PA (US)

(73) Assignee: Sure Fit Inc., Allentown, PA (US)

( * ) Notice: Subject to any disclaimer, the term of this patent is extended or adjusted under 35 U.S.C. 154(b) by 0 days.

(21) Appl. No.: 10/892,700

(22) Filed: Jul. 15, 2004

(65) Prior Publication Data

US 2008/0290705 A1 Nov. 27, 2008

Related U.S. Application Data

(63) Continuation of application No. 10/688,268, filed on Oct. 17, 2003, now abandoned.

(51) Int. Cl.
*A47C 31/11* (2006.01)

(52) U.S. Cl. ..... 297/228; 297/229; 297/228.1; 297/225

(58) Field of Classification Search ..... 297/218.1, 297/218.5, 218.4, 228, 225, 228.1, 228.11, 297/229, 219.1, 224; D6/610, 611
See application file for complete search history.

(56) References Cited

U.S. PATENT DOCUMENTS 1,698,968 A * 1/1929 Rubenstein ..... 297/218.1
1,942,111 A * 1/1934 Levi ..... 297/224
2,179,805 A * 11/1939 Trubitz ..... 297/225
2,373,071 A * 4/1945 Waranch ..... 5/51.1
2,551,214 A * 5/1951 Lenz ..... 297/224
2,667,211 A * 1/1954 Krasnov et al. ..... 297/224
2,671,499 A * 3/1954 Reavis et al. ..... 297/227
2,820,510 A * 1/1958 Sugarman ..... 297/228
2,877,832 A * 3/1959 Reavis ..... 297/228
2,921,625 A * 1/1960 Krasnov et al. ..... 297/224
3,117,817 A * 1/1964 Mednick ..... 297/224
5,028,472 A * 7/1991 Gray ..... 428/100
6,796,609 B2 * 9/2004 Illulian ..... 297/218.1

OTHER PUBLICATIONS

Domestications Sectional Sofa Slipcover Instruction Sheet, 2003.

(Continued)

*Primary Examiner*—Joseph F Edell
(74) *Attorney, Agent, or Firm*—Darby & Darby P.C.

(57) ABSTRACT

A slip cover for a sofa or love seat is disclosed. The slip cover is adjustable in a number of ways to give a good fit for a range of sofa sizes and configurations. Vents are formed in the sides of the back covering portion to accommodate the presence or absence of arms for the seating piece. The seat portion has overlapping sides to fit a range of seat sizes. Front and back skirts are used to wrap the periphery of the sofa piece, thus covering the overhanging sides of the seat portion, the front and back skirts themselves overlapping and being adjustably secured with ties and binding extensions. Arm pieces, where needed, are separate from the back/seat portion of the covering, are adjustable by tucking any excess fabric behind the ruffle seam, and are secured to the legs of the sofa piece.

22 Claims, 19 Drawing Sheets

OTHER PUBLICATIONS

Email from Brenda Miller, Oct. 16, 2003 re: Domestications Sectional Sofa Slipcover.

Slipcover Shop.com, Reviews of the product, Jul. 17, 2003.

Slipcover Shop.com, Aug. 13, 2008, (believed to describe products available as of Oct. 16, 2003.

Domestications Catalog, 2005, (Believed to describe products available as of Oct. 16, 2003.

* cited by examiner

ADJUSTABLE SLIP COVER FOR SOFAS

CROSS REFERENCE TO EARLIER APPLICATION

This is a continuation application claiming the benefit of prior-filed U.S. patent application Ser. No. 10/688,268, filed Oct. 17, 2003, entitled "ADJUSTABLE SLIP COVER FOR SOFAS."

FIELD OF THE INVENTION

The present invention relates generally to slip covers for sofas and similar seating furniture and more particularly to slip covers that are adjustable to a range of sizes and designs.

DESCRIPTION OF THE RELATED ART

Currently, if one desires to cover a sofa or other similar seating furniture with a slip cover, one must construct the slip cover for a specific piece of furniture or use a generic slip cover. The custom-fitted slip cover may fit the sofa well, but is quite expensive and, if it becomes soiled or torn, is expensive to replace. Furthermore, the slip cover is not flexible in that it is useful only for the specific piece of furniture for which it was made. Another sofa, sofa sectional, love seat may differ from the specific piece to which the slip cover was fitted in many ways. The other sofa, sofa sectional, love seat or recliner may have a larger perimeter, a higher or lower back portion, a wider or narrower back portion, a larger or smaller seating portion, one arm instead of two, two arms instead of one, or no arms, higher or lower arm height, or a recliner function. These differences in size and style make the custom-fitted slip cover unworkable for anything but the sofa for which it was made. The generic slip cover requires that a large piece of material be placed over the sofa piece with the seams of the arms aligned over the front of each arm and centered. The material is adjusted in the front of the sofa piece so that the hem is even with the floor. Excess material be tucked either behind the seat cushion(s) or into the crevices between the arms and seat cushion(s) and the back of the seat cushion (s). The problem with the generic slip cover is that movement of the cushions which are being used to hold the excess fabric may release the excess fabric, giving an unkempt appearance and requiring that the generic cover be re-tucked after the sofa piece is used. This is not an acceptable solution for a sofa piece that has a great deal of use. Thus, there is a need for an affordable slip cover that can properly fit a great ranges of styles and designs of sofas or other similar seating.

BRIEF SUMMARY OF THE INVENTION

The present invention is directed towards the above need. An embodiment of the present invention is a slip cover for a sofa seat including a back portion, a seating surface and a supporting portion. The slip cover includes a body piece, a back ruffle piece, seat piece and a front ruffle piece. The body piece includes a generally rectangular back piece and left and right side pieces formed and joined to fit the back portion, where each side piece and the back piece forming a vent therebetween for adapting to a left or right sofa arm when present. The generally rectangular back ruffle piece has a plurality of ties, is joined by a seam to the body to cover the supporting portion of the sofa about the back and sides, and has a binding extension extending at the left and right ends from the seam of the body piece. The seat piece is joined to the body piece such that side portions of the seat piece can overhang the sides of the seating surface of the sofa-like seat to fit a range of seating surface sizes. The generally rectangular front ruffle piece has a plurality of ties, is joined by a seam to the seat piece to cover the supporting portion of the sofa about the front and sides, and has a binding extension extending at the left and right ends from the seam. The front and back ruffles overlap and connect with the ties and binding extensions so as to adjustably wrap around the periphery of the sofa, covering any overhanging side portions of the seat piece.

Another embodiment is a slip cover for a wedge-shaped sofa seat including a back portion, a seating surface and a supporting portion. The slip cover includes a back piece, left and right side pieces, a back ruffle piece, a seat piece and a front ruffle piece. The back piece is configured to cover the back portion, where the back piece has a rear edge and a front edge and the front edge is shorter than the rear edge, and where left and right edges extend approximately parallel from the rear edge and break at an angle near an apex mark to meet with the front edge. The left and right side pieces are configured to cover the sides of the back portion, where each side piece has a curved shape with an apex, the left side piece is joined to the parallel portion of the left side edge of the back piece, and the right side piece is joined to the parallel portion of the right side edge of the back piece, such that the apexes are aligned with the apex marks of the back piece. The generally rectangular back ruffle piece having a plurality of ties, where the back ruffle piece has a long edge joined by a seam to the back edge of the back piece and side pieces to cover the supporting portion of the sofa about the back and sides, and has a binding extension extending at the left and right ends from the seam of the back ruffle piece. The generally rectangular seat piece is joined to the front edge of the back piece, where the seat piece has side portions overhanging the sides of the seating surface of the sofa-like seat to fit a range of seating surface sizes. The generally rectangular front ruffle piece has a plurality of ties, where the front ruffle piece has a long edge joined to a front edge of the seat piece to cover the supporting portion of the sofa about the front and sides, and has a binding extension extending at the left and right ends from the seam of the front ruffle piece. The front and back ruffles overlap and connect with the ties and binding extensions so as to adjustably wrap around the periphery of the sofa, covering any overhanging side portions of the seat piece.

An advantage of the present invention is that a single slip cover can accommodate a range of size differences in the height of the back portion.

Another advantage is that a single slip cover can accommodate a range of size differences in the width of the back portion.

Yet another advantage is that a single slip cover can accommodate a range of size differences in the seating portion of the seating piece.

Yet another advantage is that a range of size differences in the overall perimeter of the seating piece is easily accommodated by a single slip cover.

Yet another advantage is that a single slip cover can accommodate whether the seating piece has no, one or two arms, and the height of the arms, if any.

Yet another advantage of the present invention is that a single slip cover can be used for a variety of seat piece shapes, such as a sofa or loveseat, including reclining sofas or loveseats, wedge pieces, and oversized sofas.

Yet another advantage is that management of inventory is simplified because a smaller number of pieces needs to be stocked, each of the pieces being adjustable to a range of sizes.

BRIEF DESCRIPTION OF THE DRAWINGS

These and other features, aspects and advantages of the present invention will become better understood with regard to the following description, appended claims, and accompanying drawings where:

DETAILED DESCRIPTION OF THE INVENTION

Figure 1A:
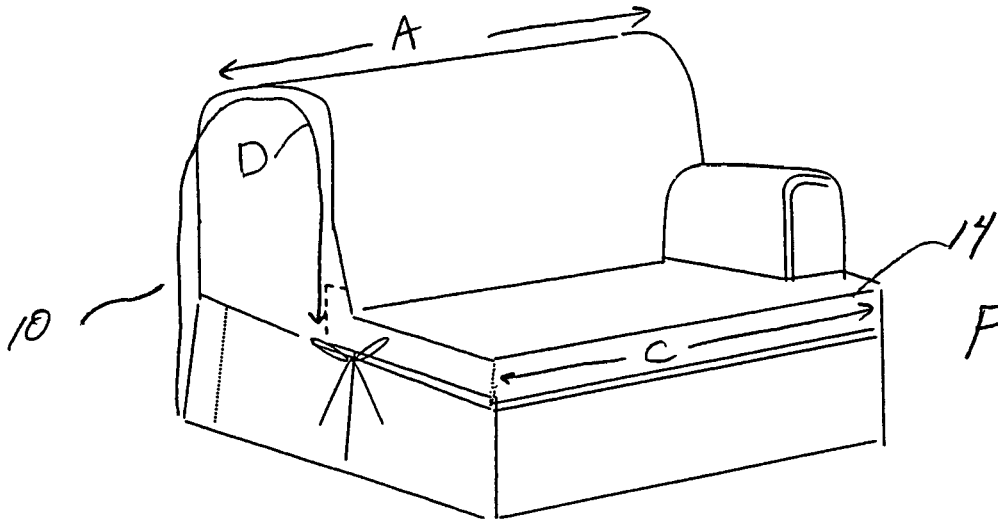
FIGS. 1A-1E show slip covers for a variety of sofa styles accommodated by the present invention.
Figure 1B:
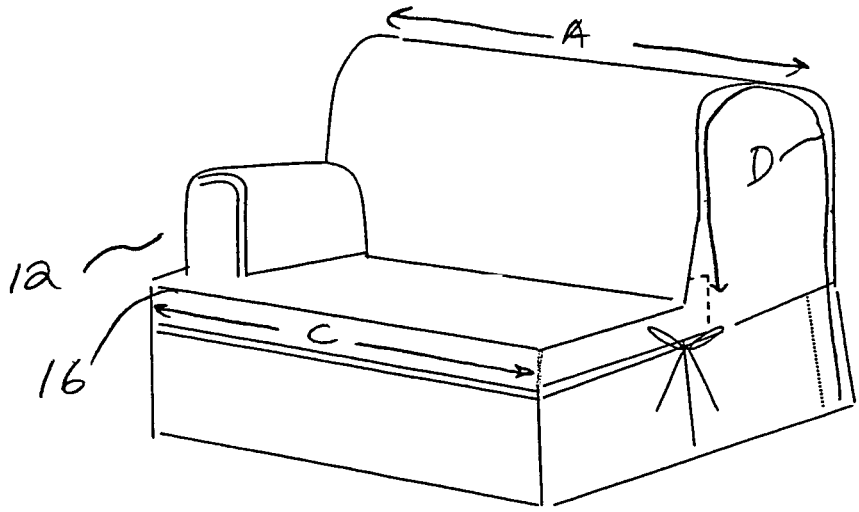

FIGS. 1A-1E and 2A-2C show sofas with slip covers for a variety of sofa styles and sizes accommodated by the present invention. FIG. 1A shows the slip cover 10 of the present invention for a sofa piece with a right arm and FIG. 1B shows a slip cover 12 for a sofa piece with a left arm. Each piece and has a T-shaped cushion 14, 16, respectively. The T-shaped pieces of FIG. 1A and 1B may have sizes A, C and D, of approximately 50-56 inches, 50-56 inches, and 64-74 inches, respectively, where A is the width of the back portion, C is the width of the T-cushion and D is the inside contour of the side portion of the back, for a medium-sized sofa piece. Alternatively, the T-shaped pieces may have sizes A, C and D, of approximately 65-80 inches, 65-80 inches, and 64-74 inches, respectively, for a large-sized sofa piece.

Figure 1C:
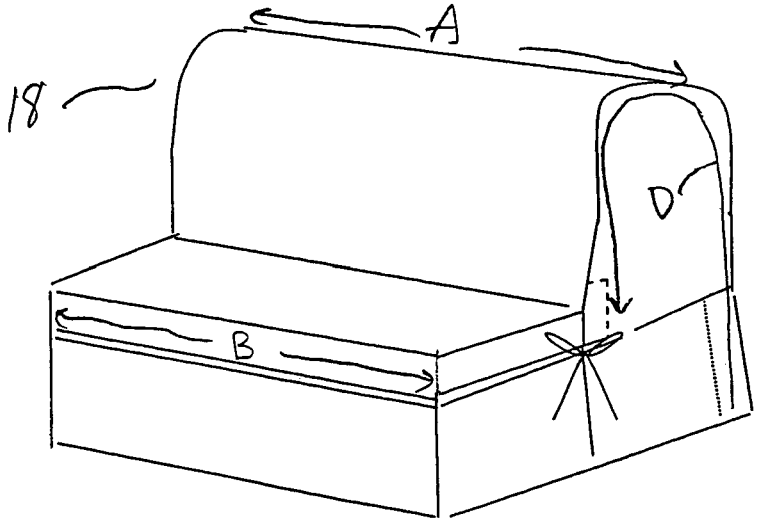

FIG. 1C shows an embodiment 18 for covering an armless sofa or loveseat in accordance with the present invention. Dimensions for the armless sofa may have sizes A, B and D, of approximately 50-56 inches, 50-56 inches, and 64-74 inches, respectively, where A is the width of the back portion, B is the width of the cushion and D is the inside contour of the side portion of the back, for a medium sized sofa piece. Alternatively, the armless sofa may have sizes A, B and D, approximately 65-80 inches, 65-80 inches, and 64-74 inches, respectively, for a large-sized sofa piece.

Figure 1D:
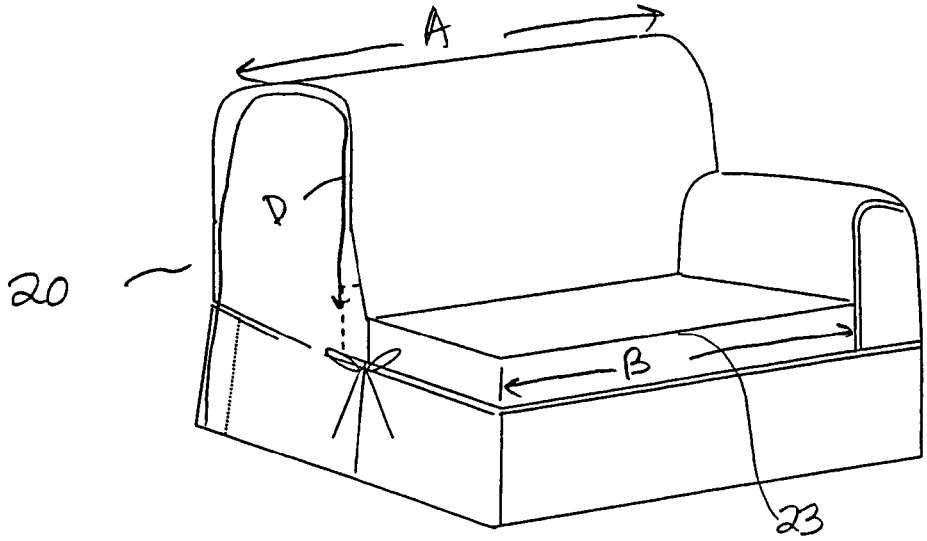
Figure 1E:
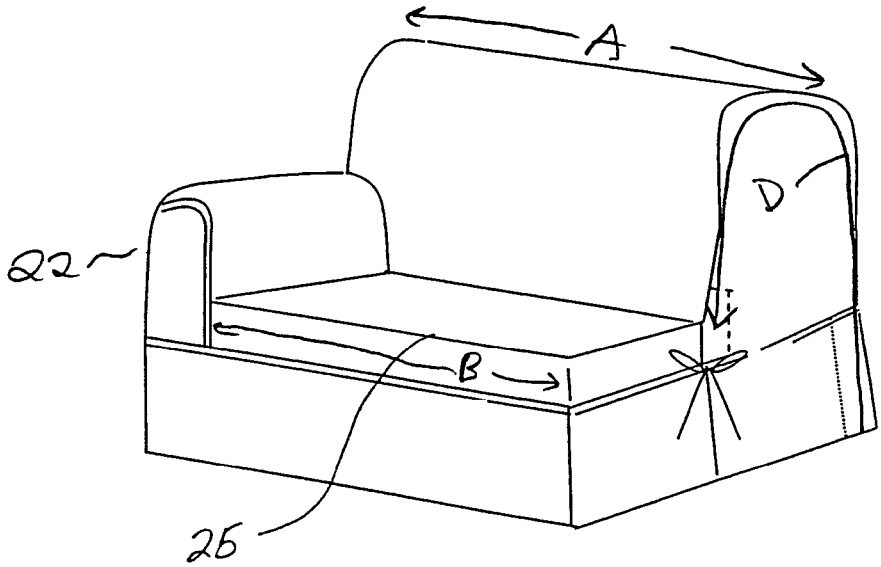

FIGS. 1D and 1E show right arm version 20 and a left arm version 22, respectively, with regular cushions 23, 25. The regular cushion pieces may have sizes A, B, and D, of approximately 50-56 inches, 50-56 inches, and 64-74 inches, respectively for a medium sized sofa piece, where A is the back width, B is the regular seat cushion width and D is the contour. Alternatively, the regular cushion pieces may have sizes A, B, and D, of approximately 65-80 inches, 65-80 inches, and 64-74 inches, for a large-sized sofa piece.

Figure 2A:
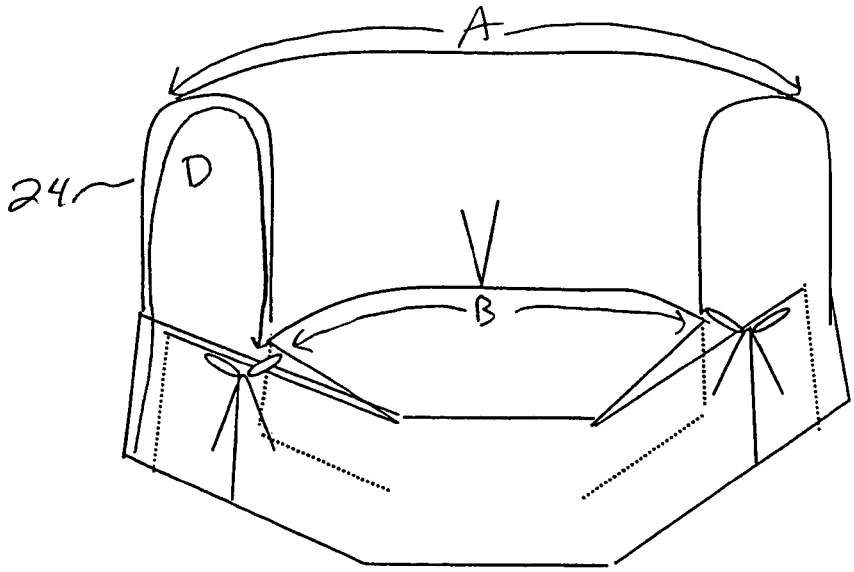
FIGS. 2A-2C show slip covers for a variety of sofa styles accommodated by the present invention.

FIG. 2A shows an embodiment 24 for a wedge-shaped sectional piece. The wedge-shaped piece may have sizes A, B, and D, of approximately 64-76 inches, 36-46 inches, and 64-74 inches, respectively.

Figure 2B:
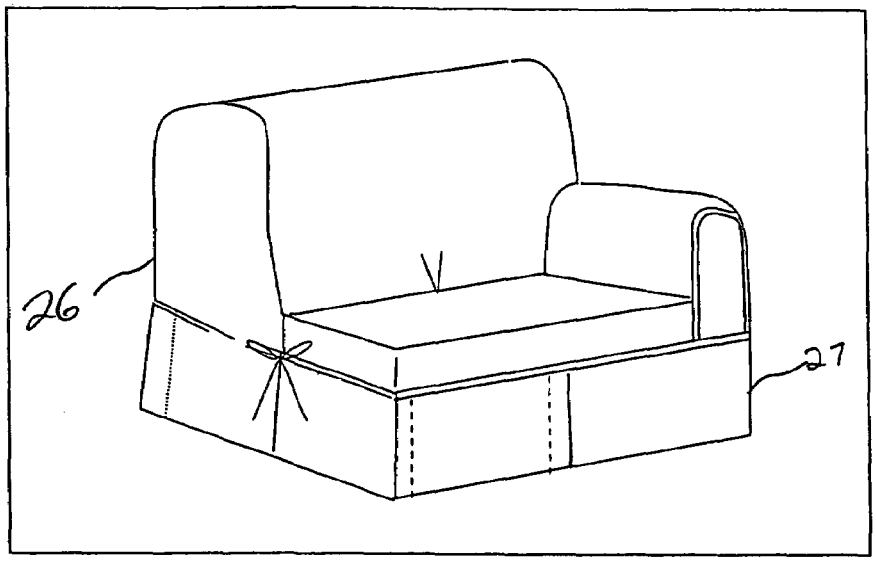
Figure 2C:
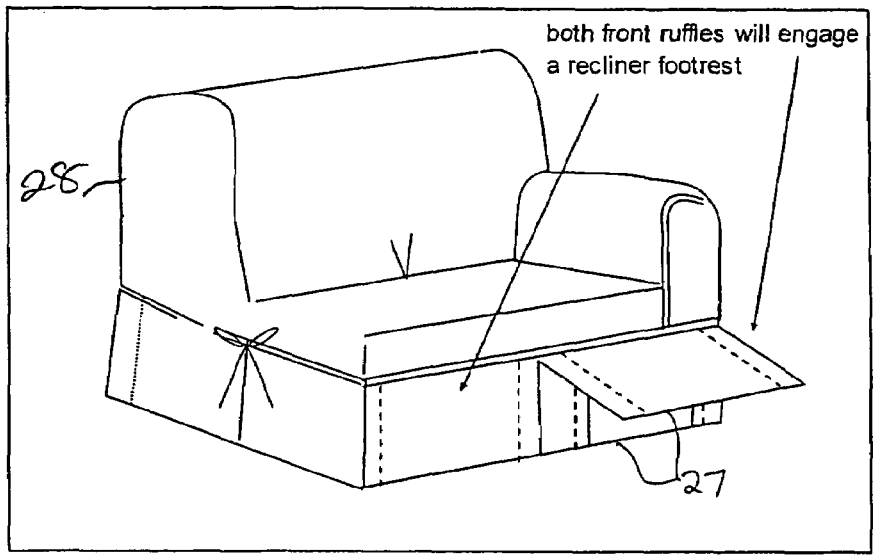

FIGS. 2B and 2C show a recliner configuration 26, 28 and the modified front ruffle 27 for that configuration. Each of the embodiments features a cover for the sofa back and back sides, the sofa seat area, and a skirt (ruffle) for the support area below the seat area. The skirt is wrapped around the periphery of the seating unit between the floor and the seat area, with an overlap, and connected with ties, as described in more detail below. If any sofa arms are present, these are covered with a separate cover.

Figure 3A:
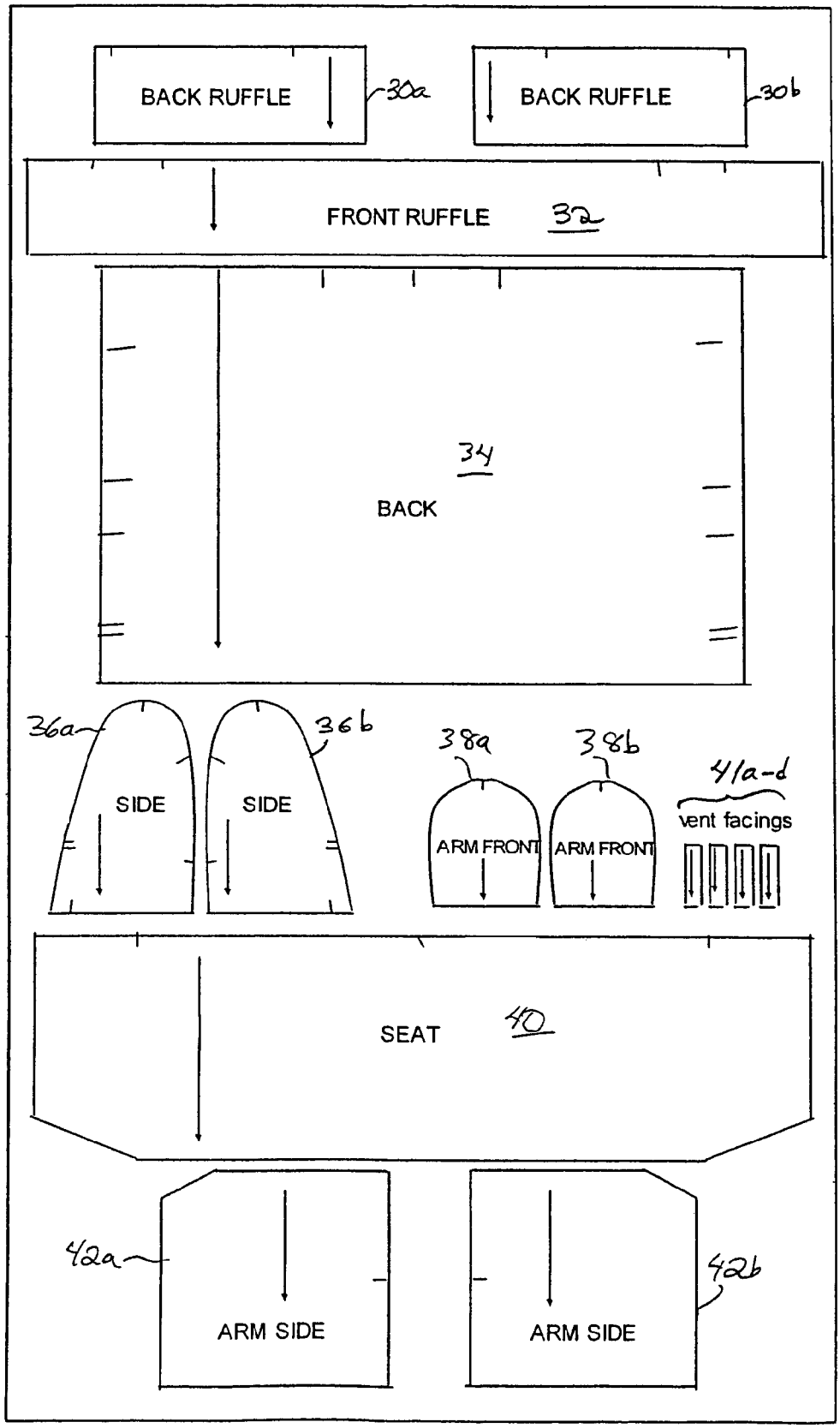
FIG. 3A shows pattern pieces for making an embodiment of a slip cover of the present invention.

FIG. 3A shows the pattern pieces for making an embodiment of a slip cover of the present invention, the embodiment being a section loveseat or sofa. The pattern pieces include a pair of back ruffle pieces 30*a*, 30*b*, a front ruffle piece 32, a back piece 34, left and right side pieces 36*a*, 36*b*, a pair of arm fronts 38*a*, 38*b*, four vent facing pieces 41*a-d*, a seat piece 40, and left and right arm sides 42*a*, 42*b* for covering arms of a sofa, when they are present. The arrows show the warp direction of the fabric. In addition to the above mentioned pieces, ties are required. Ties are lengths of covering material approximately 20 inches long and cut with a 1¾ inch bias. The ties are preferably finished with a clean finish folder.

Figure 3B:
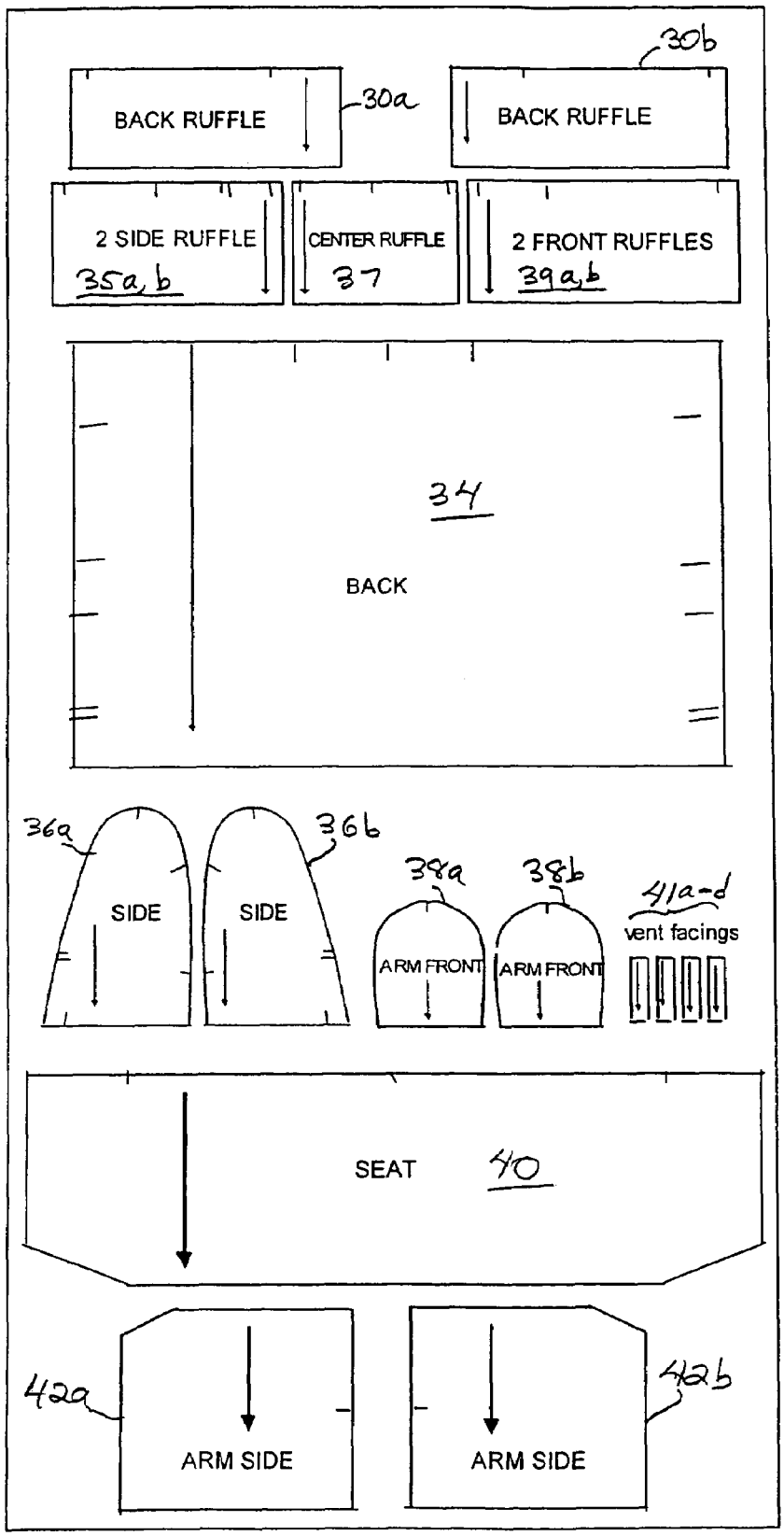
FIG. 3B shows pattern pieces for making another embodiment of a slip cover of the present invention.

FIG. 3B shows the pattern pieces for making an embodiment of a slip cover of the present invention, the embodiment being a reclining loveseat or sofa. The pattern pieces include back ruffles 30*a*, 30*b*, five front ruffle pieces 35*a-b*, 37, 39*a-b*, a back piece 34, side pieces 36*a-b*, arm fronts 38*a-b*, four vent facing pieces 41*a-d*, a seat piece 40, and arm sides 42*a-b*. In this embodiment, the front ruffle is constructed, as described below, from five separate pieces 35*a-b*, 37, 39*a-b* to permit the movement of the foot rest of the recliner.

Figure 4:
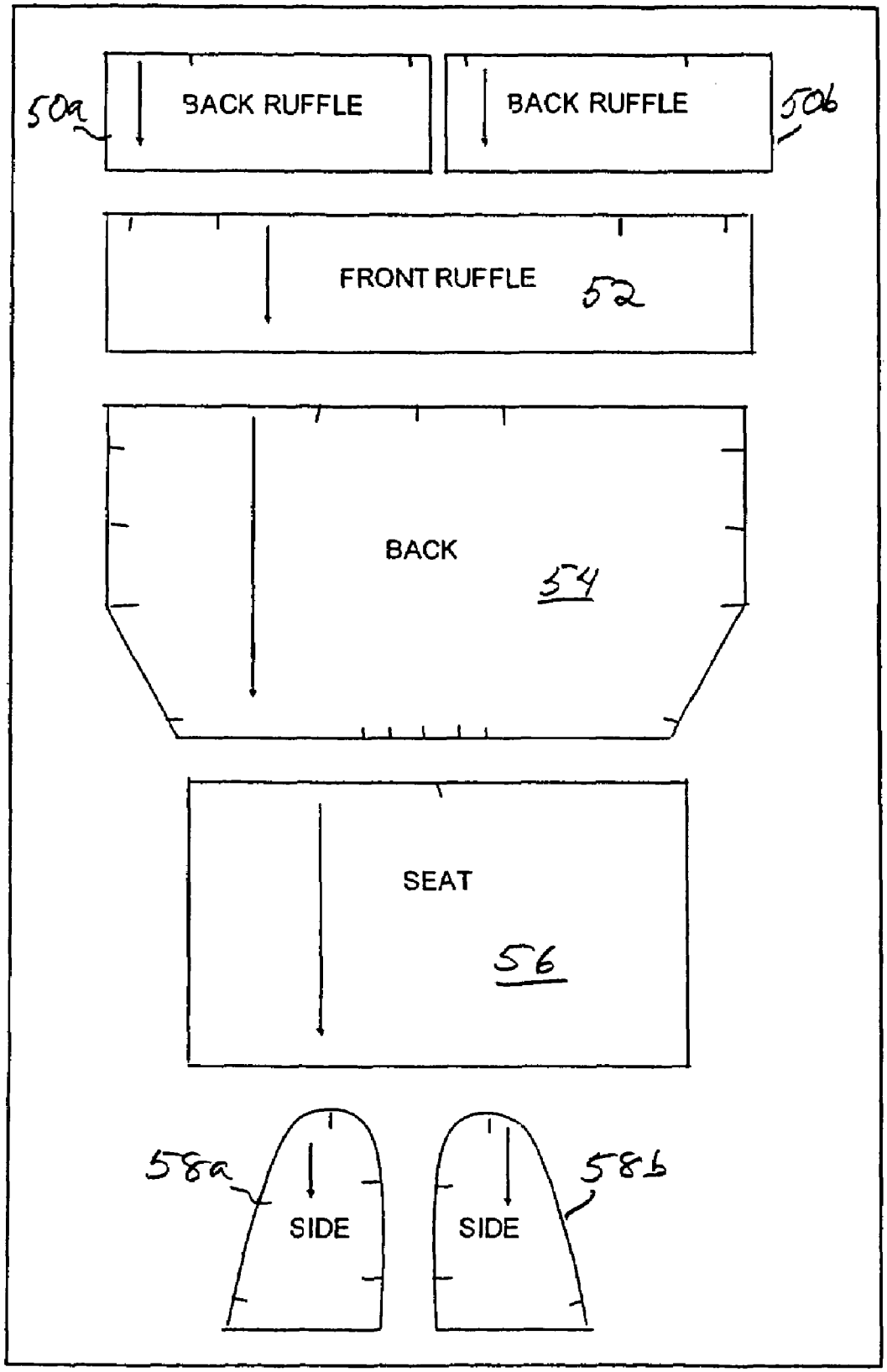
FIG. 4 shows the pattern pieces for making yet another embodiment of a slip cover of the present invention.

FIG. 4 shows the pattern pieces for making yet another embodiment of a slip cover of the present invention, this embodiment being a wedge sectional component. The pattern pieces include a pair of back ruffle pieces 50*a*, 50*b*, a front ruffle piece 52, a back piece 54, a seat piece 56, and left and right side pieces 58*a*, 58*b*. Again, ties as described above, are needed.

Figure 5A:
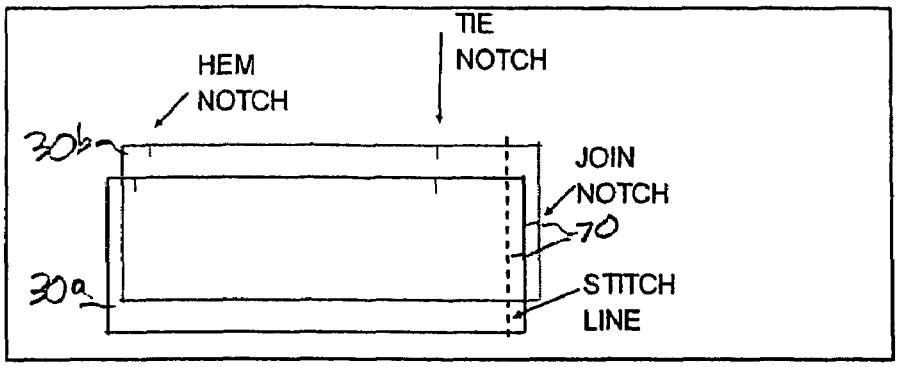
FIGS. 5A to 5O show the construction steps for making a slip cover in accordance with one embodiment the present invention.
Figure 5B:
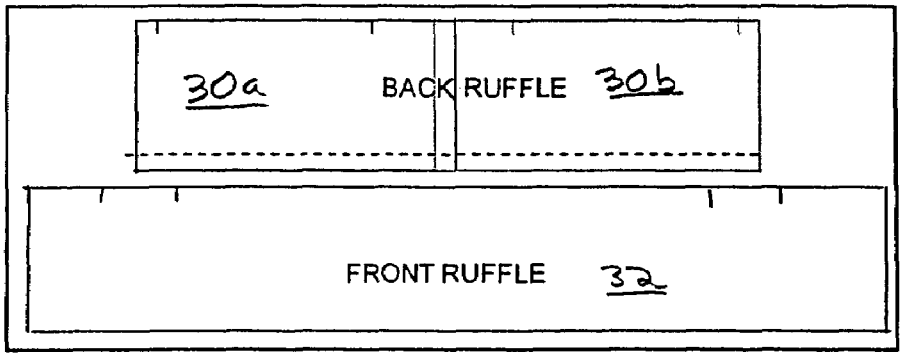
FIGS. 5P to 5T show substitute construction steps for making a slip cover in accordance with another embodiment of the present invention.
Figure 5C:
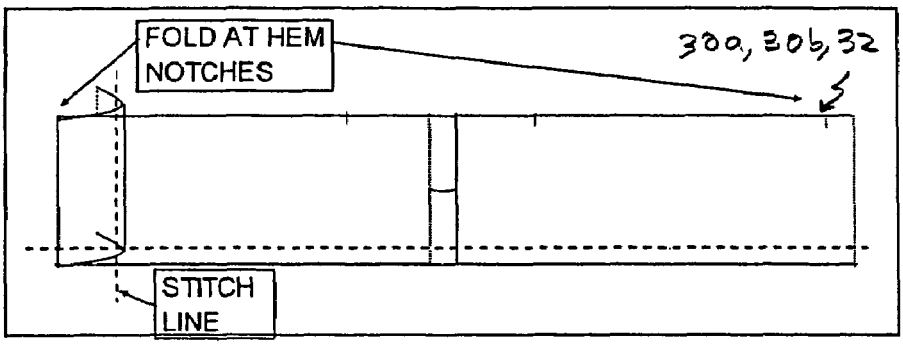
Figure 5D:
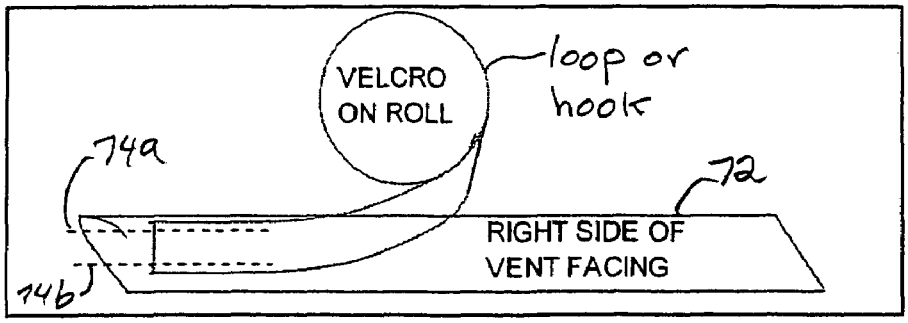
Figure 5E:
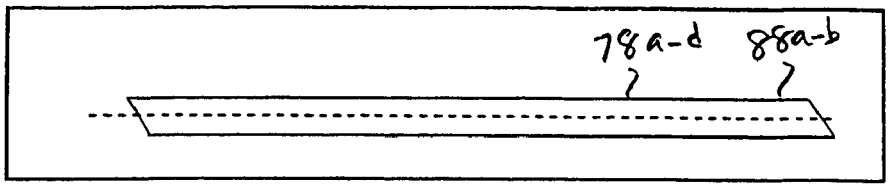
Figure 5F:
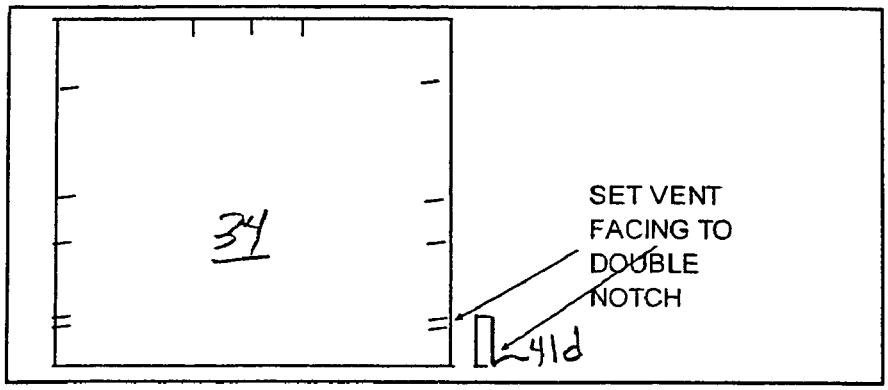
Figure 5G:
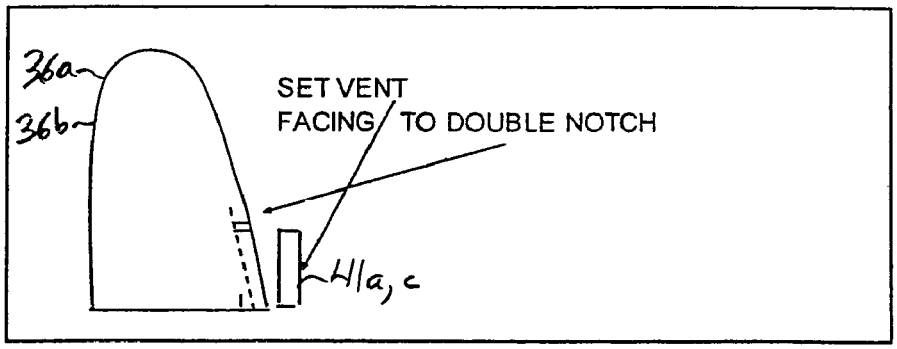
Figure 5H:
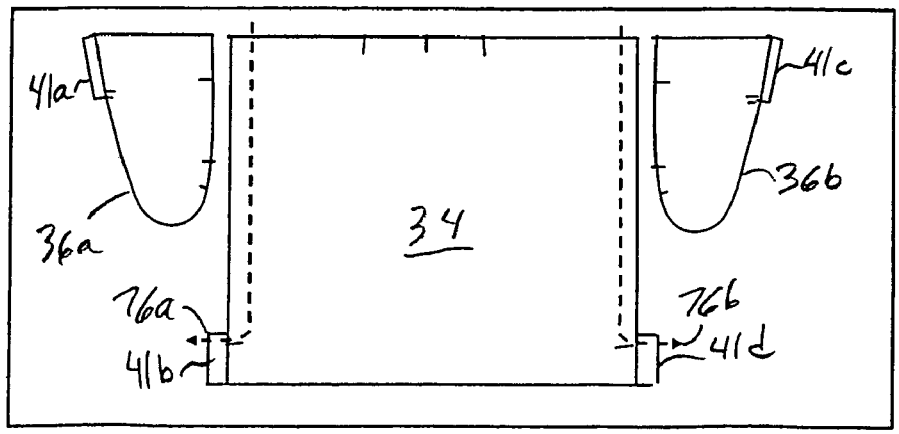
Figure 5I:
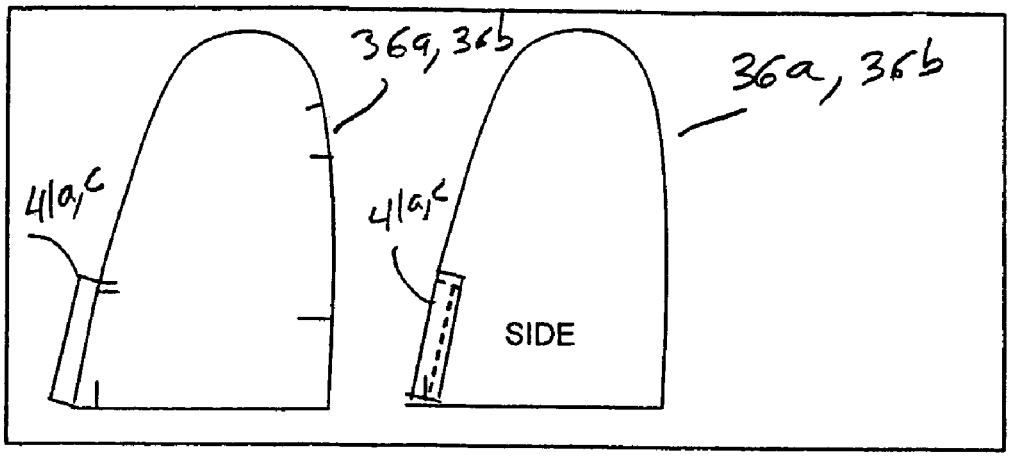
Figure 5J:
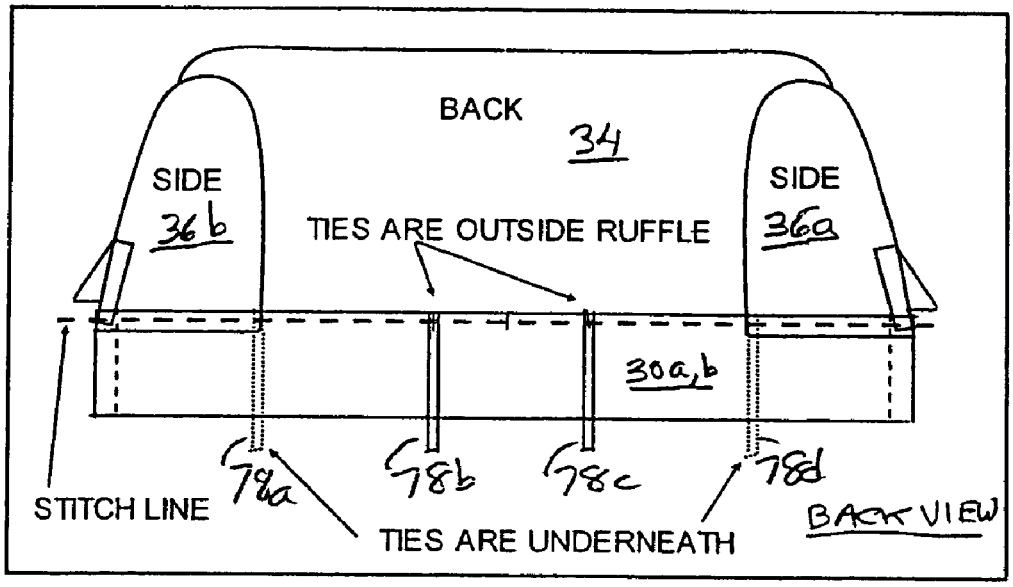
Figure 5K:
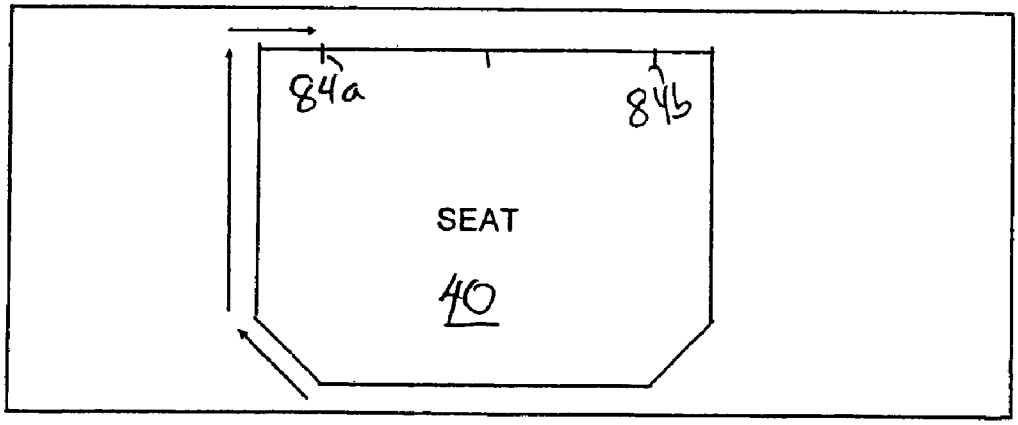
Figure 5L:
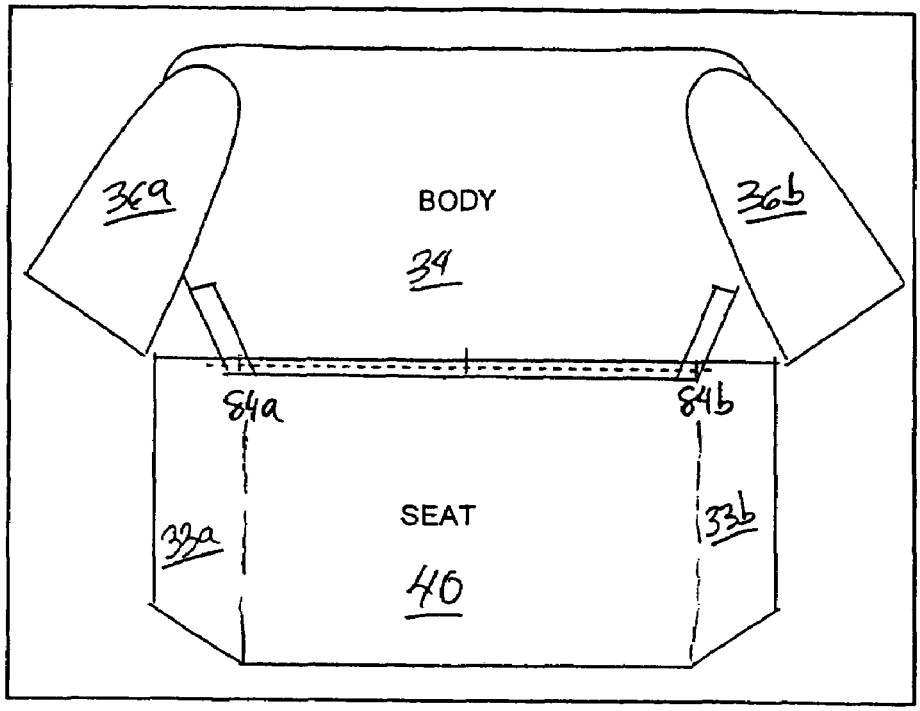
Figure 5M:
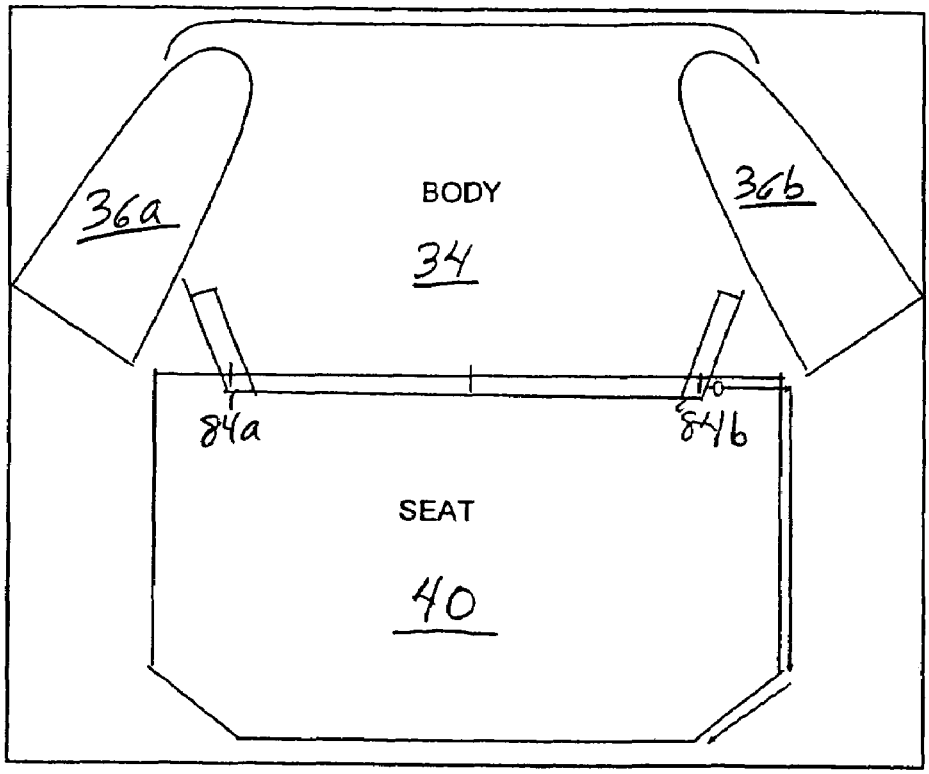
Figure 5N:
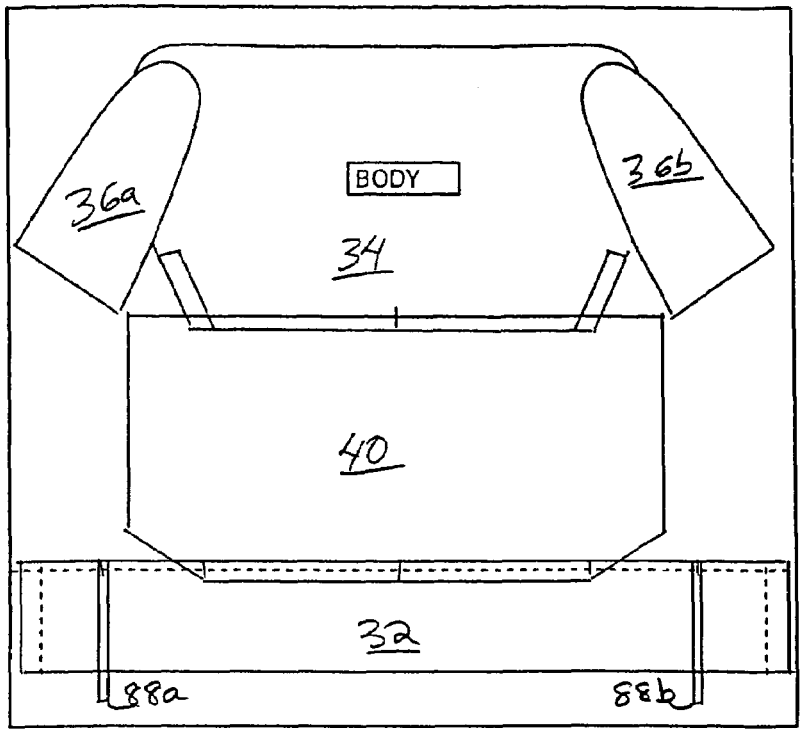
Figure 5O:
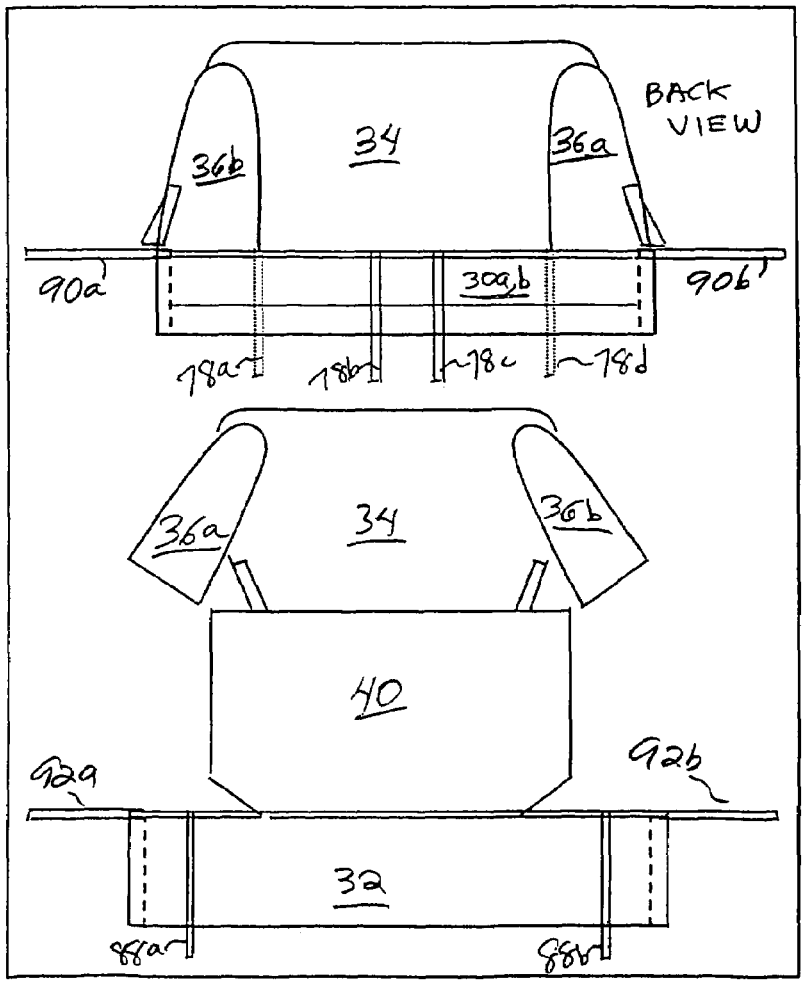

FIGS. 5A to 5O show construction steps for making a slip cover in accordance with the present invention.

In FIG. 5A, the back ruffle pieces 30*a*, 30*b* are aligned at the join notches 70 and are sewn together with the right sides facing each other. A safety stitch is used, which is five-thread stitch comprising a chain stitch adjacent to an overlock stitch, which finishes the edges.

Next, in FIG. 5B, the joined back ruffles and the front ruffle are hemmed with a finished ⅜ inch double-rolled hem, using a single needle chain stitch.

In FIG. 5C, the sides of the front and back ruffles 30*a*, 30*b*, 32 are hemmed. Each side is folded 1½ inches at the hem notches with ½ inch turned under and then stitched with a single needle lockstitch.

Next, as shown in FIG. 5D, two pairs of vent facing pieces are prepared. Each vent facing piece 72 is straight cut and made into approximately a ten inch length. An edge of a 2¼ inch piece of vent facing is folded over ⅜ inch, with right sides facing. Next, the wrong side of a Velcro® strip in one case a loop strip and in another case a hook strip, are sewn in place, using a pair 74*a*, 74*b* of double needle chainstitches. One of the double needle stitches 74*b* joins the wrong side of the Velcro® strip to the right side of the facing, and the other double needle stitch 74*a* joins both the turned fabric and Velcro® strip together, such that the raw edge of the facing is covered by the wrong side of the Velcro® strip. Four vent facing pieces are made in this step, two with hook strips and two with loop strips.

In FIG. 5E, eight ties are made, each cut to a 20 inch length and preferably finished with a clear finish folder.

Next, in FIG. 5F, two vent facing pieces, each with the loop side of the Velcro® strip, are joined, using a safety stitch, to the left and right sides, respectively, of the back piece 34 at the double notches shown.

In FIG. 5G, two more vent facing pieces, each with the hook side of the Velcro® strip, are joined, using a safety stitch, to the left and right side pieces 36*a*, 36*b*, respectively, at the double notches shown.

In FIG. 5H, the side pieces 36*a*, 36*b* and the back pieces 34 are sewn together using a safety stitch, such that vent facing pieces 41*b, d* of the back 34 align to the vent facing pieces 41*a, c* of the side pieces 36*a*, 36*b*. During this operation, the safety stitch traverses the width of the facing pieces to define the apexes 76*a*, 76*b* of the vent. The vent facing pieces of each side piece are folded over and top stitched at 1½ inches, using a single needle lockstitch, to each side piece 36*a*, 36*b*, as shown in FIG. 5I. The vents formed by the vent facing pieces 41*a-d* are designed to accommodate an arm of the sofa. If the arm is present, the vent is opened to allow the front of the back piece to fit around the arm. Otherwise, the vent is closed by means of the Velcro® strips on the facing pieces.

In FIG. 5J, a back view of the joined side and back pieces, four ties 78*a-d* and the back ruffle 30*a-b* are joined, using a safety stitch, to the side 36*a*, 36*b* and back pieces 34 (already joined together). Two ties 78*a*, 78*d* are joined at side seams to the wrong side of the back ruffle and another two ties 78*b*, 78*c* are joined at the notches left and right of the center on the right side of the back ruffle. The inside ties and binding extensions are used to adjustably connect the overlapping front and back ruffles. This completes the portion of the cover that covers the back of the sofa.

In FIG. 5K, the seat portion 40 is edged, using a safety stitch, starting at the left front and moving around the left side until the left side notch 84*a* is reached.

In FIG. 5L, the seat portion, is joined, using a safety stitch, with center notches aligned, to the body 34, 36*a-b*, only between the left and right notches 84*a-b* of the seat portion 40, the left and right notches 84*a-b* being approximately aligned with the loop Velcro® facing pieces of the body. Thus, the sides 33*a*, 33*b* of the seat piece are left free to overhang over the sides of the seating portion of the sofa, the amount of overhang depending on the width of the seat piece.

In FIG. 5M, the right side of the seat piece 40 is edged, using a safety stitch, from the right notch 84*b* of the seat piece to the start of the front of the seat piece.

Next, in FIG. 5N, the front ruffle 32 is joined to the assembled body, side and seat pieces 34, 36*a-b*. Importantly, the ruffle 32 is joined, with center notches aligned, only along the front edge of the seat piece 40. Because the sides of the seat piece, starting approximately at the left and right notches, respectively, will hang over the left and right sides of seat of the sofa, they will be overlapped by the front and back ruffles. A single safety stitch is used to edge the front ruffle piece, to connect a left side tie 88*a* to the front ruffle at the left notch, then to connect the front edge of the seat piece to the front ruffle piece, then to connect a right side tie 88*b* to the front ruffle and then to edge the remainder of the front ruffle piece.

In FIG. 5O, the front ruffle 32 and back ruffle 30*a-b* are finished with a binding leaving 20 inch binding extensions 92*a-b*, 90*a-b* at the ends of the front and back ruffles, respectively. The bindings are cut with a 1¾ inch bias and attached with a clean finish folder. The 20 inch binding extensions 92*a-b*, 90*a-b* are used as ties to connect the front ruffle to the back ruffle. In particular, binding extension 90*b* is tied to tie 88*a*, and binding extension 92*a* is tied to tie 78*d* to join the front and back ruffles on the left side of the sofa piece. Binding extension 90*a* is tied to tie 88*b* and binding extension 92*b* is tied to tie 78*a* to join the front and back ruffles on the right side of the sofa piece. Ties 78*b* and 78*c* on the back ruffle are tied together. This completes the slip cover, unless the sofa piece to be covered has one or two arms.

Figure 5P:
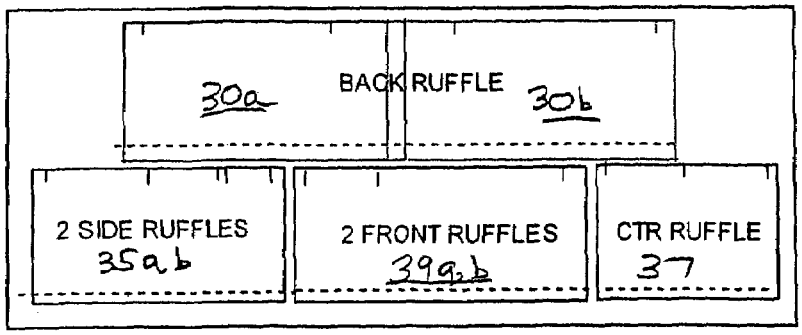
Figure 5Q:
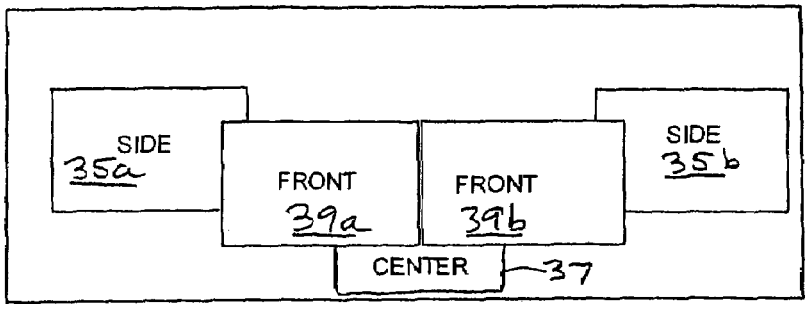
Figure 5R:
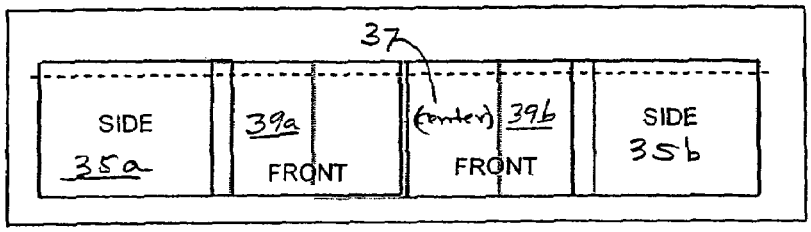
Figure 5S:
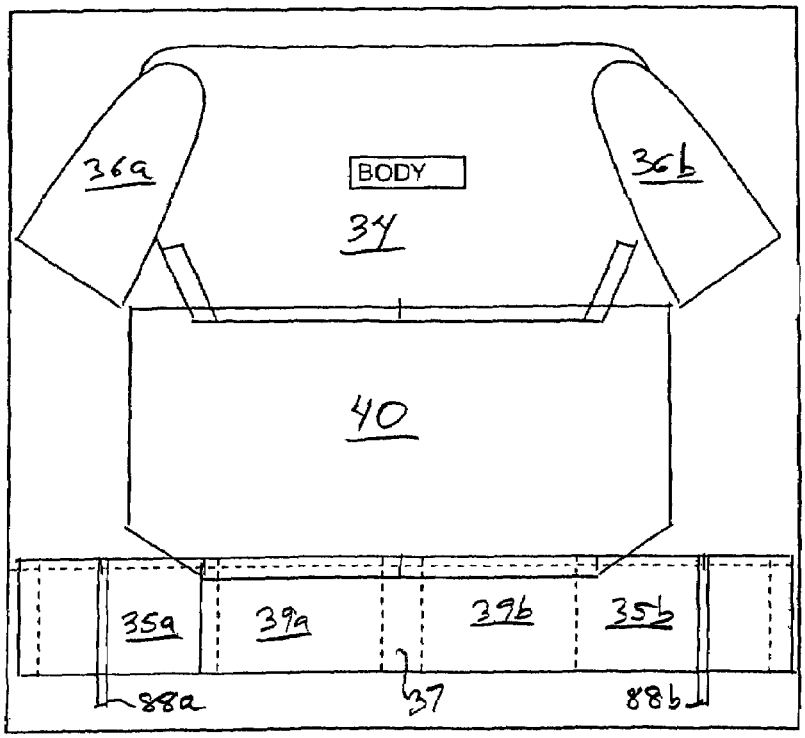
Figure 5T:
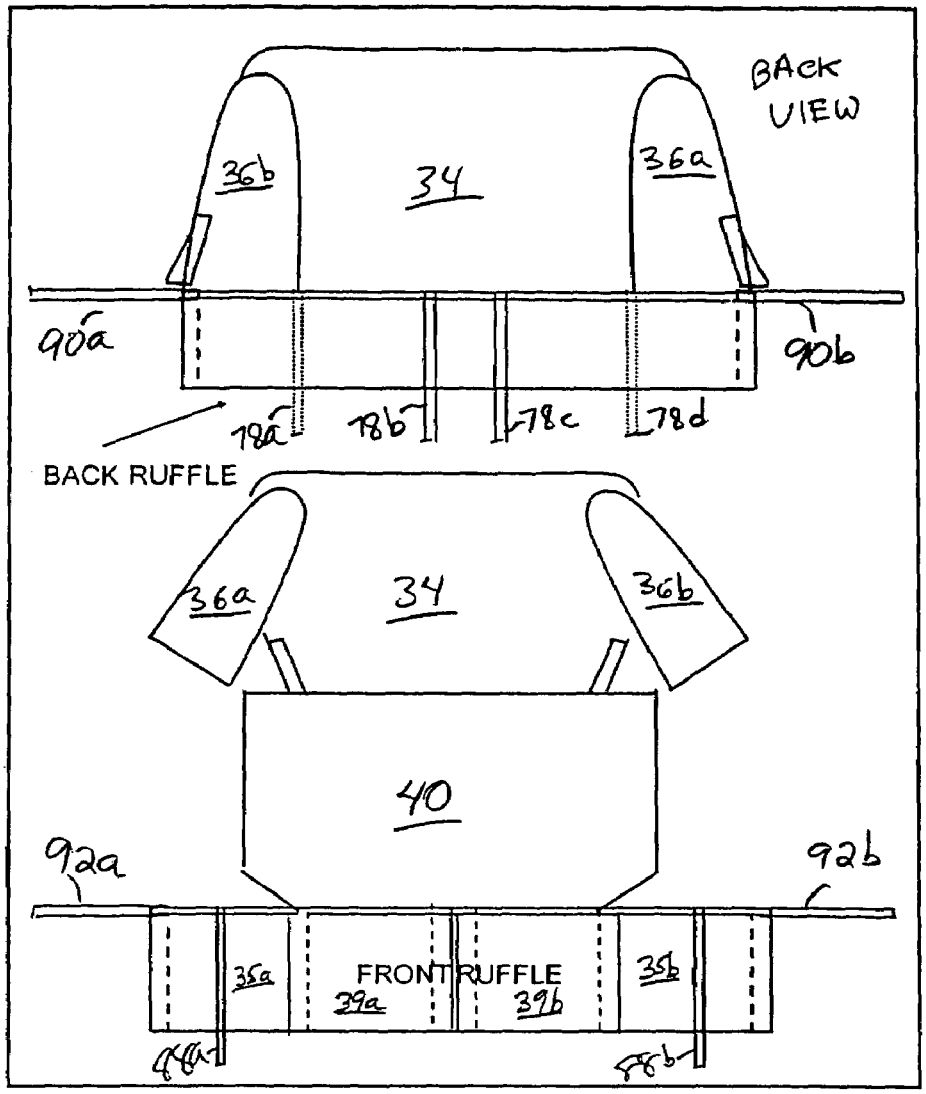

FIGS. 5P to 5T show substitute construction steps for making a slip cover in accordance with the recliner embodiment of the present invention. In particular, FIG. 5P shows the hemming of the back ruffle 30*a-b* and the front ruffle pieces 35*a-b*, 37 and 39*a-b*, and replaces the construction step in FIG. 5B, when a reclining piece is to be covered. FIGS. 5Q and 5R show the construction of the front ruffle from the pieces shown in the pattern piece FIG. 3B. These are new steps required because the ruffle is now constructed from five smaller pieces. The ruffles are stitched together in the order of side piece 35*a*, front recliner piece 39*a*, center ruffle piece 37, front recliner piece 39*b*, and side piece 35*b*, such that the center ruffle piece 37 is underneath the front recliner pieces 39*a-b* and the side pieces 35*a-b* are partially under the front recliner pieces 39*a-b*, which open upward when the recliner function is engaged. A single needle lockstitch is used to join the pieces together. FIG. 5S shows the step of connecting the assembled front ruffle piece to the front edge of the seat piece. Similar to the construction step shown in FIG. 5N, with a single stitch, the front ruffle piece is edged, a tie is added at the first notch, the ruffle is joined to the front edge of the seat piece from the second notch to the third notch, another tie is added at the fourth notch, and then the remaining portion of the ruffle is edged. The ties are added to the right side of the ruffle. FIG. 5T, similar to FIG. 5O, shows the step of adding binder extensions to the back ruffle and to the front ruffle. Similar to FIG. 5O, in FIG. 5T, binding extension 90*b* will be tied to tie 88*a* and binding extension 92*a* will be tied to tie 78*d* to connect the front and back ruffles on the left side, and binding extension 90*a* will be tied to tie 88*b* and binding extension 92*b* will be tied to tie 78*a* to connect the front and back ruffles on the right side. Ties 78*b* and 78*c* are tied together.

Figure 6A:
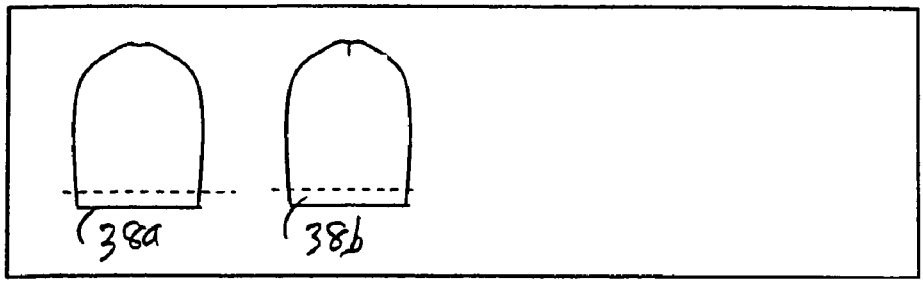
FIGS. 6A to 6F show the construction steps for making arm covers for attachment to the slip covers, in accordance with the present invention.
Figure 6B:
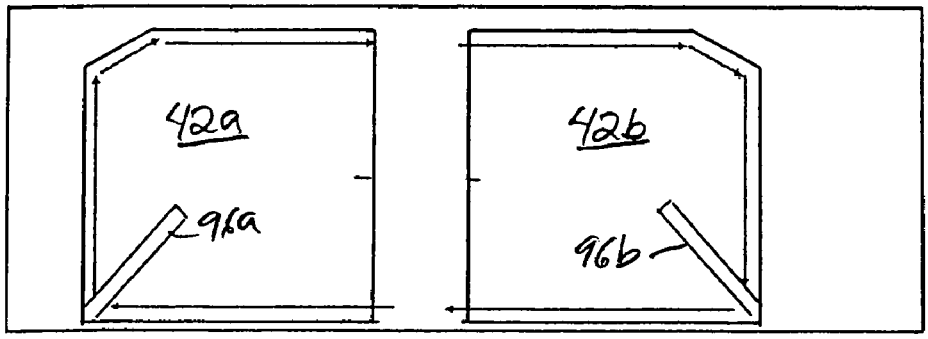

In FIG. 6A, the arm fronts 38*a*, 38*b* are edged using a safety stitch and, in FIG. 6B, the arm sides 42*a-b* are edged on three sides, as shown, using a safety stitch. The remaining two ties 96*a-b* are connected by means of the safety stitch at the back outside corner of each arm side.

Figure 6C:
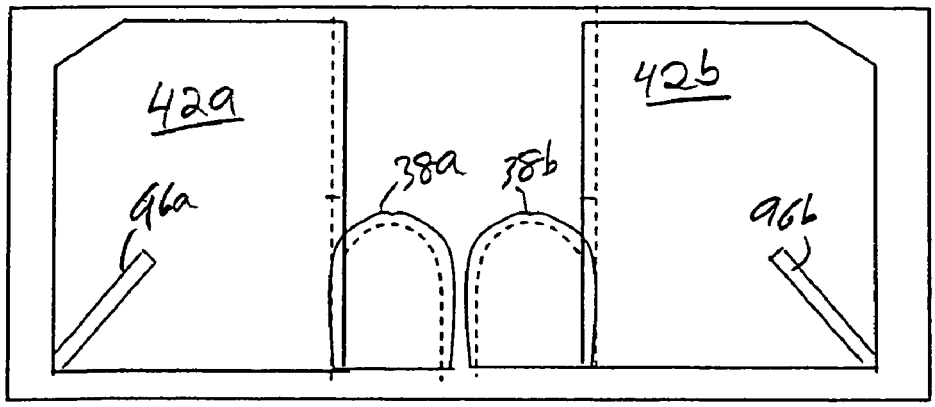
Figure 6D:
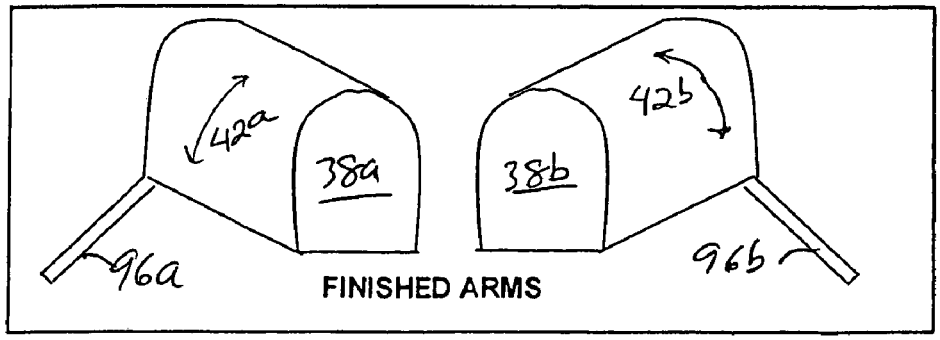

In FIG. 6C, each arm front 38*a-b* is joined with a safety stitch to its arm side 42*a-b*, left to left and right to right. FIG. 6D shows the finished arms.

Figure 6E:
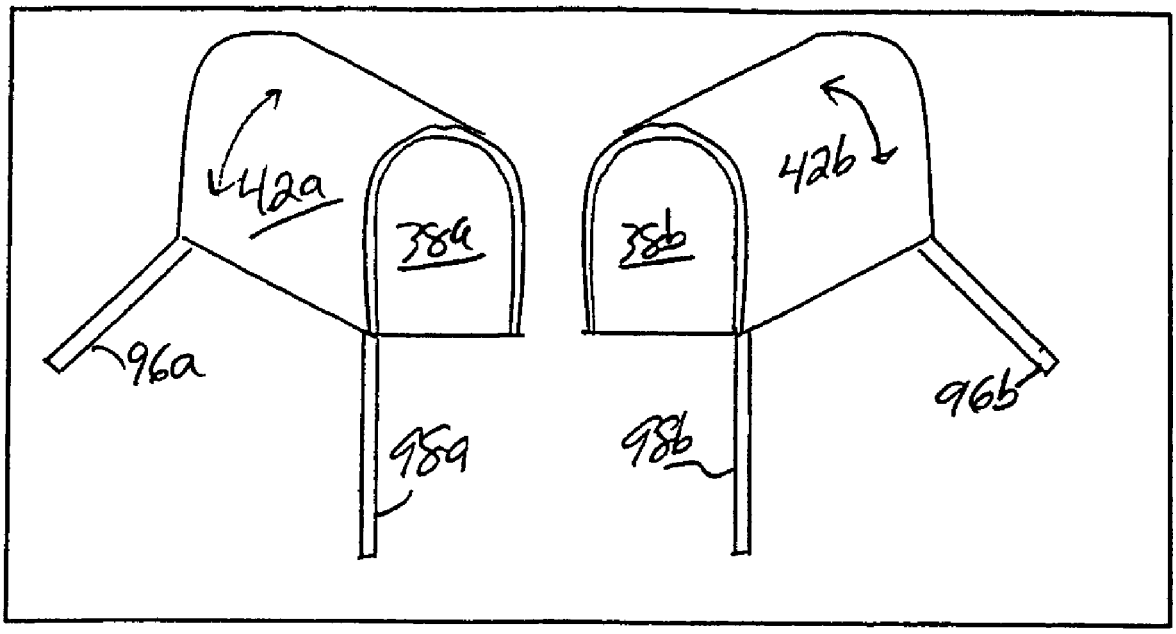
Figure 6F:
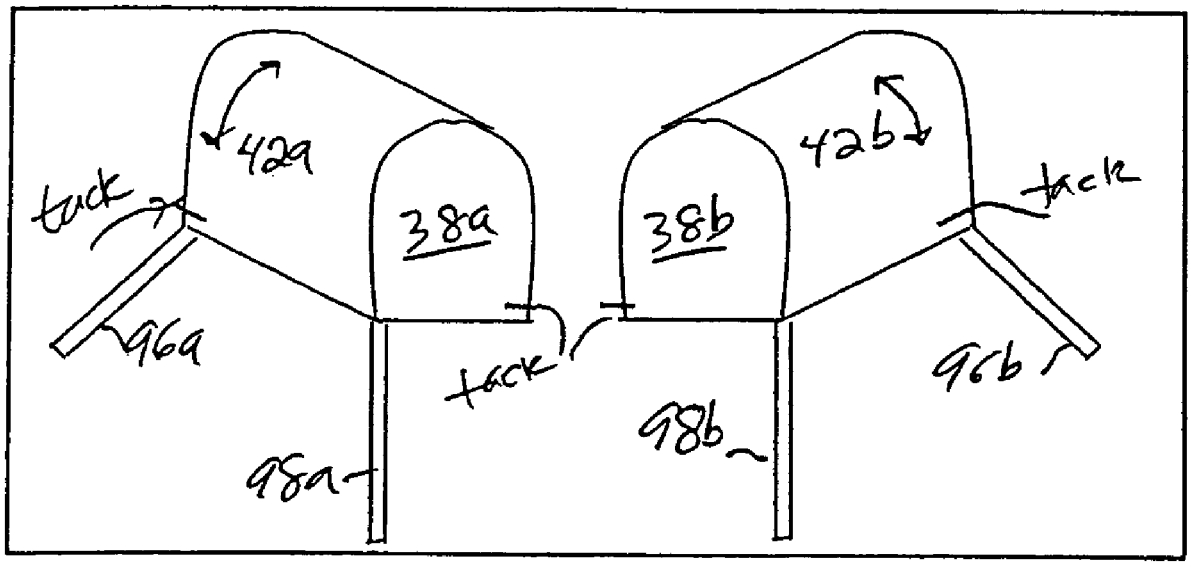

In FIG. 6E, the arm fronts are bound with a clean finish folder binding, using a single needle chainstitch, leaving 20 inch extensions 98*a-b* for ties at the front outside corners, as shown. The ties are then tacked at the back corners and the binding edges is tacked at the front inside corners, as shown in FIG. 6F. In use, tie 96*a* is will be tied to the left rear leg of the sofa piece and binding extension 98*a* will be tied to the left front leg. Tie 96*b* will be tied to the right rear leg and binding extension 98*b* will be tied to the right front leg.

As is clear from the construction details, a portion of the back piece 34, depending on the height of the back portion of the sofa, may hang below the seating area in the rear, a portion 33*a*, 33*b* of the seat piece 40 in FIG. 5L may overhang the seat of the sofa on the left and right sides, depending on the size of the seat portion of the sofa. Both are overlapped by the front 32 and back ruffles 30*a-b*, themselves overlapping for a clean look and neat fit. Ties are provided to connect the overlapping portions of the front and back ruffles. Adjustment to the specific shape of the seating piece to be covered is accomplished by tucking any excess fabric behind the ruffle seam which is covered with bias binding. The chain stitching by which the bias binding is attached allows the material to stretch tightly around the periphery of the unit. The separate arm pieces for the loveseat and sofa are also adjustable to size by tucking excess fabric behind the ruffle seam and into the seat area.

When the seat piece is a recliner, the construction details regarding the front ruffle are modified to account for the foot resting portion of the recliner, which moves forward and upward in the reclining position. The overlapping of the front pieces over the center and side pieces provides coverage for the foot resting portion of the recliner.

Figure 7A:
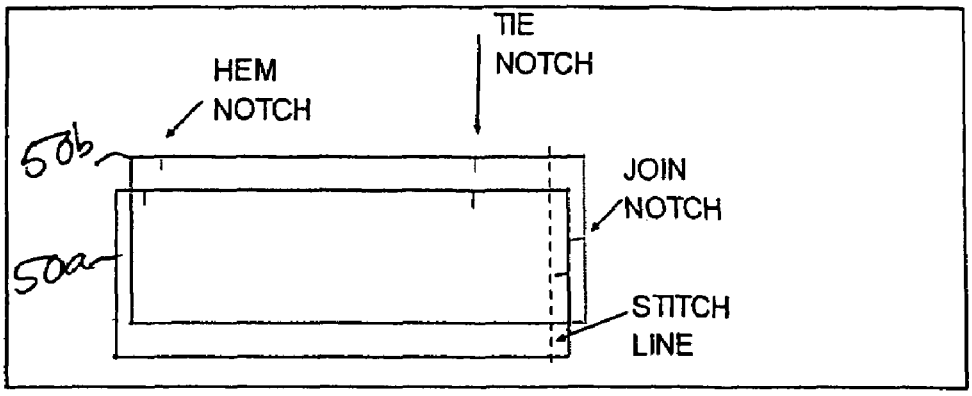
FIGS. 7A to 7L, show the construction steps for making a slip cover in accordance with another embodiment of the present invention.

FIGS. 7A to 7L show the fabrication steps for another embodiment of the present invention, a wedge sectional component. In FIG. 7A, the back ruffle pieces 50*a-b* are aligned at the join notches with right sides facing, and joined with a safety stitch.

Figure 7B:
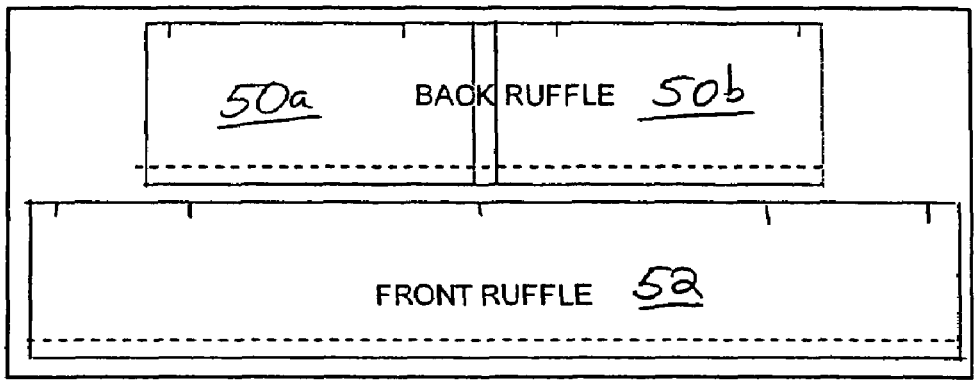

In FIG. 7B, the front ruffle 52 and back ruffles 50*a-b* are hemmed along the length using a single needle chainstitch. The hem is a ⅜ inch finished double roll hem.

Figure 7C:
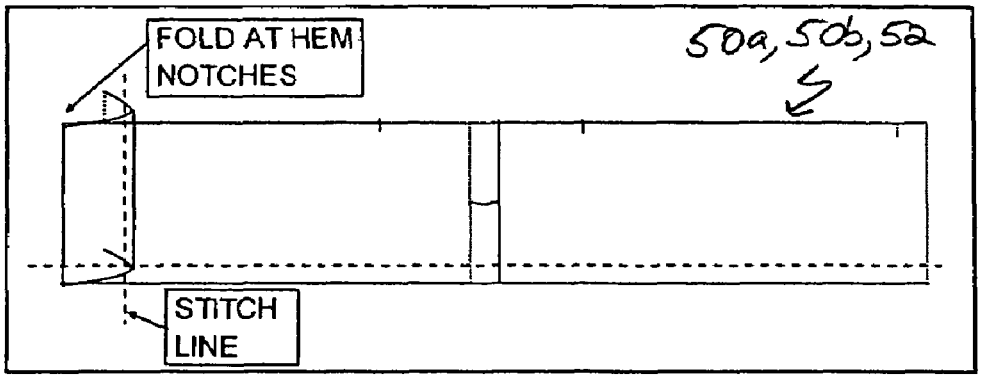

In FIG. 7C, the front ruffle 52 and back ruffles 50*a-b* are folded at the hem notches and hemmed along the width (the sides) with a 1½ inch hem, ½ inch turned under, using a single needle lockstitch.

Figure 7D:
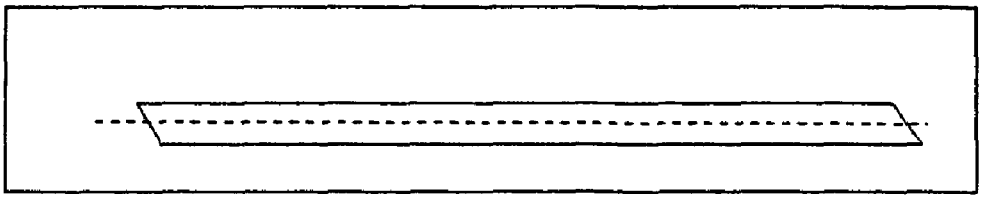

In FIG. 7D, six ties are constructed using a single needle chainstitch and a clean finish folder. The ties are cut 20 inches in length.

Figure 7E:
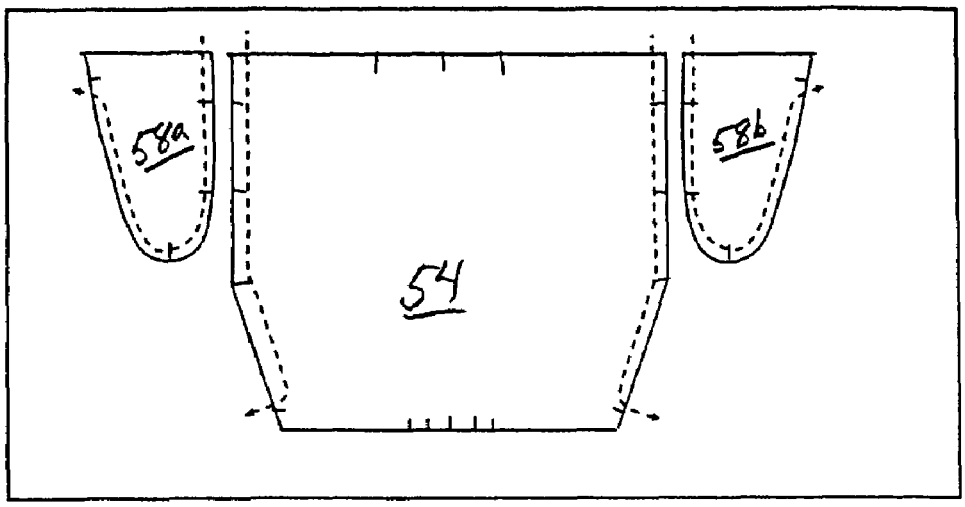

In FIG. 7E, the side pieces 58*a-b* are sewn to the back piece 54 with a safety stitch, with notches aligned, such that a vent opening is left between the bottom of each side piece and the bottom of the back piece. More particularly, the back piece 54 has a rear edge and a front edge that is shorter than the rear edge. Left and right edges of the back piece 54 extend approximately parallel from the rear edge and then break at an angle near an apex mark, which is indicated by a notch, to meet with the front edge. The resulting shape is important for achieving the proper fit of the back of the wedge-shaped sofa piece. The left and right side pieces cover the sides of the back portion, with each side piece having a curved shape with an apex. The left side piece is joined above the top of the vent to the parallel portion of the left side edge of the back piece, and the right side piece is joined above the top of the vent to the parallel portion of the right side edge of the back piece, such that the apexes are aligned with the apex marks of the back piece.

Figure 7F:
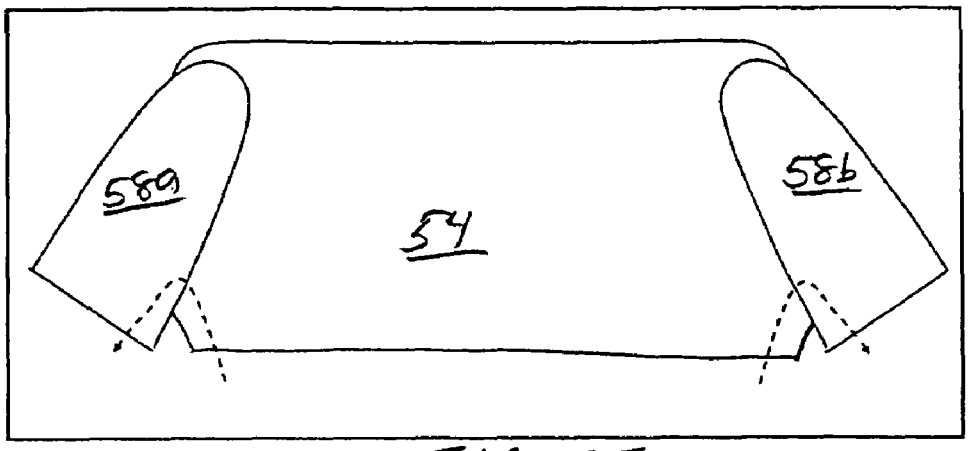

In FIG. 7F, the edges of the vent openings of the joined back 54 and side pieces 58*a-b* are edged with a safety stitch.

Figure 7G:
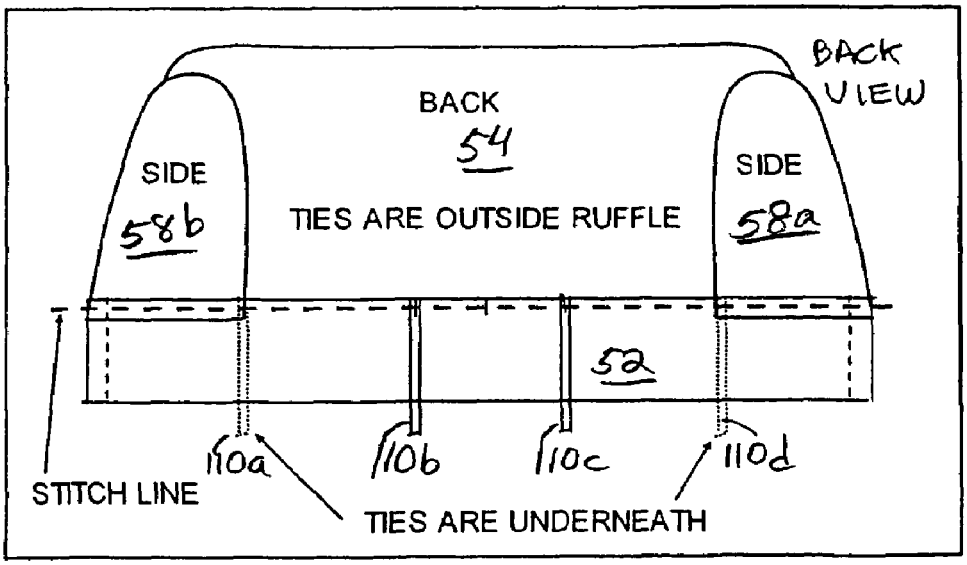

In FIG. 7G, a back view of the back, the back ruffle is sewn using a safety stitch to the joined back 54 and side pieces 58*a-b*. In this stitching operation, two ties 110*a*, 110*d* are joined at the side seams to the wrong side of the ruffle and two ties 110*b*, 110*c* are joined at the notches at either side of center on the right side of the ruffle. Ties 110*a*, 110*d* will serve to adjustably secure overlapping portions of the front ruffle to the back ruffle.

Figure 7H:
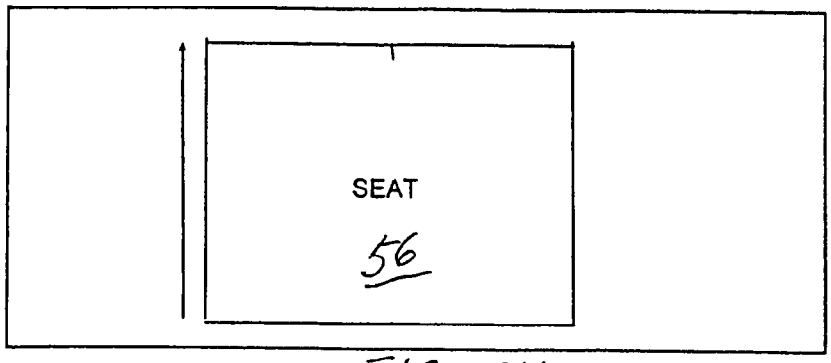
Figure 7I:
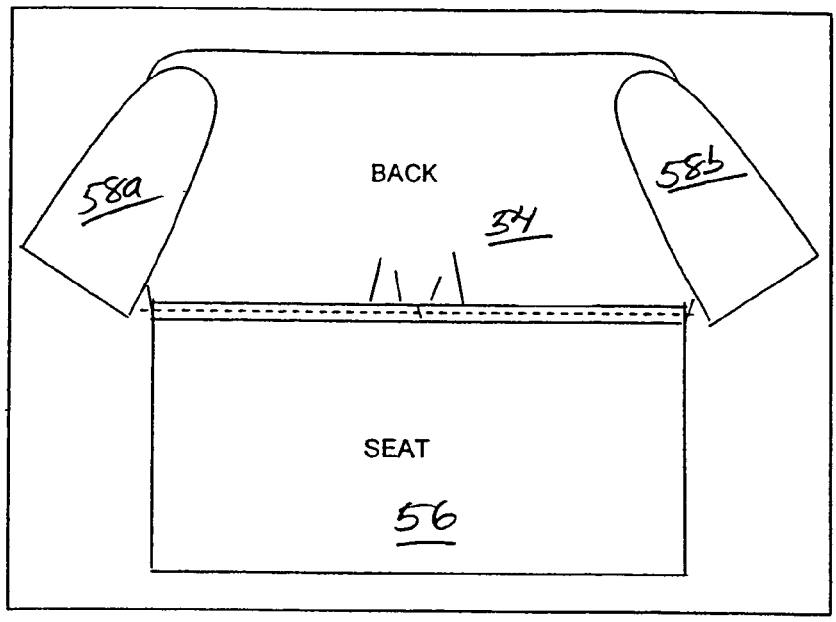
Figure 7J:
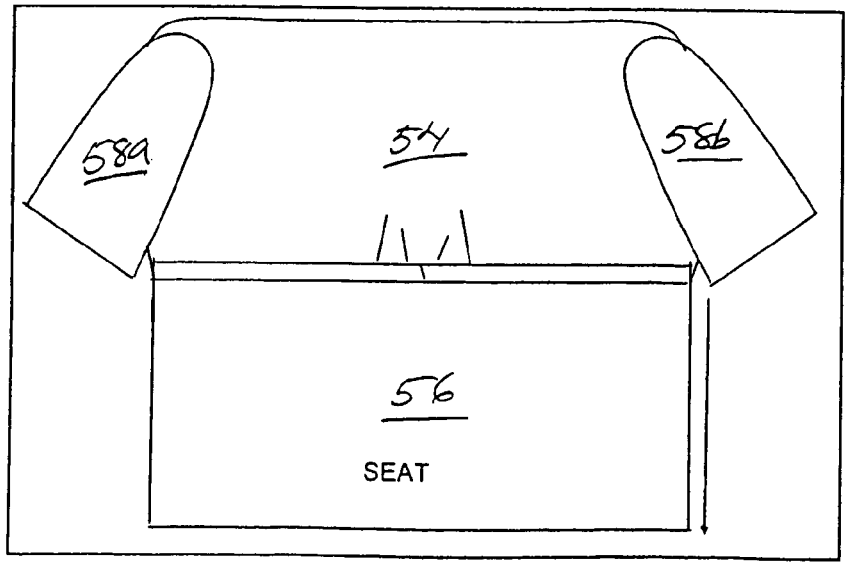

Next, in FIG. 7H, the seat piece 56 is edged with a safety stitch on the left side, and then in FIG. 7I, joined to the back piece 54 with a safety stitch. During this safety stitch operation, a pleat is formed at the notches in the back piece 54. In FIG. 7J, a safety stitch is used to edge the right side of the seat piece.

Figure 7K:
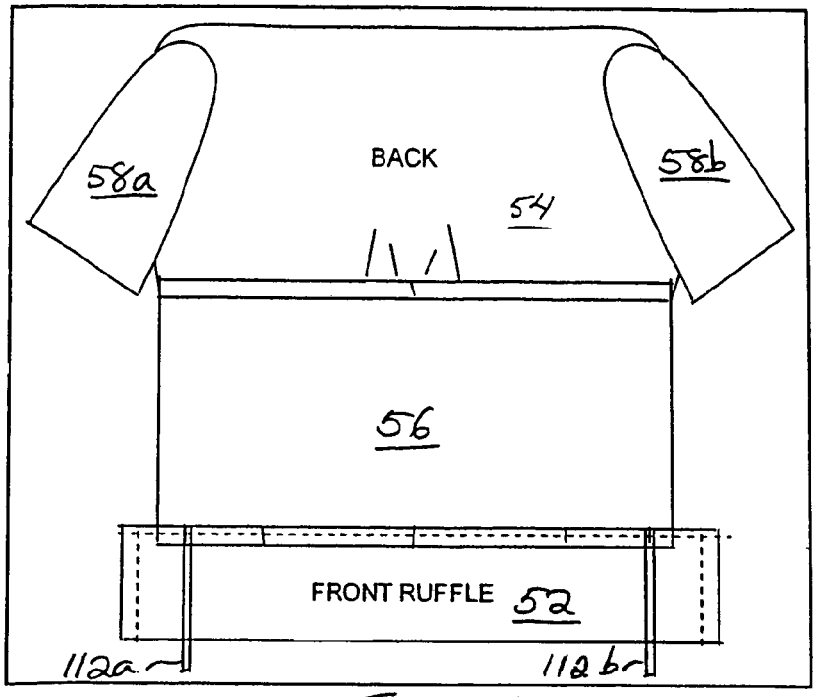

In FIG. 7K, the front ruffle 52 is attached to the front edge of the seat piece 56, using a safety stitch. In the safety stitch operation, two ties 112*a-b* are joined at the notches. In one version, the front ruffle 52 is longer than the length of the front edge of the seat piece 56.

Figure 7L:
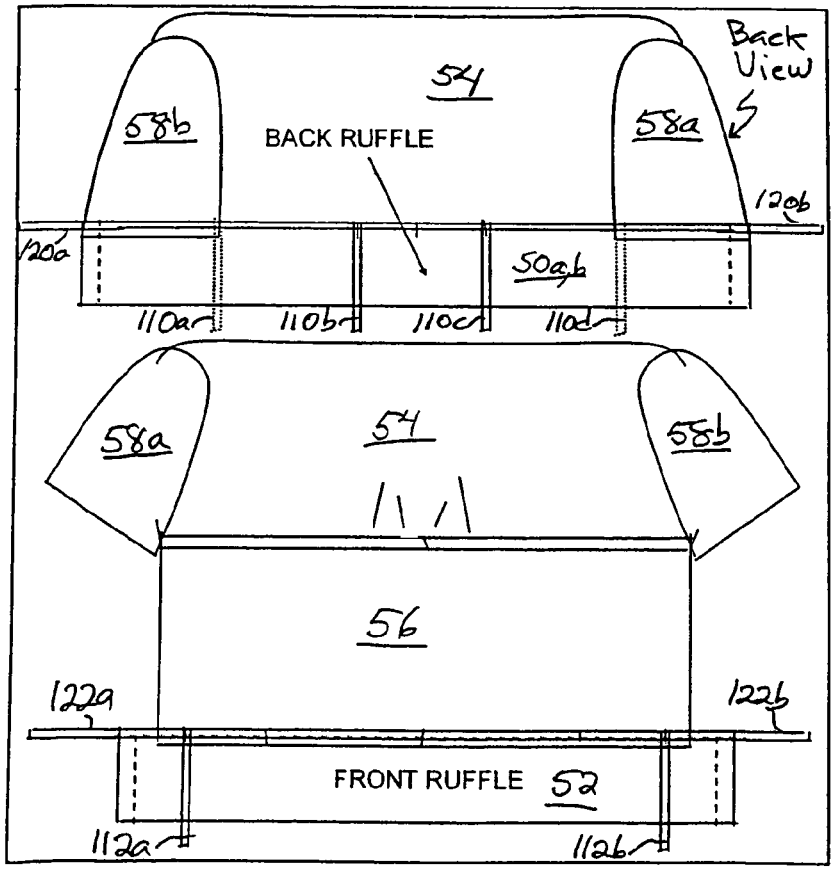

In FIG. 7L, bindings with extensions 122*a-b*, 120*a-b* are added to the front ruffle 52 and back ruffle 50*a-b*, respectively. The bindings are made with a clean finish folder and 20 inch extensions are left at the ends of the front and back ruffles. In use, binding extension 120*b* is tied to tie 112*a*, and binding extension 122*a* is tied to 110*d* to join the front and back ruffles on the left side. Also, binding extension 120*a* is tied to tie 112*b* and binding extension 122*b* is tied to 110*a* to join the front and back ruffles on the right side. Ties 110*b* and 110*c* are tied together. As is clear from the construction details of this embodiment, a pleat is used in the back piece at the center front to adjust for the back piece curvature.

Installation of the slip cover for a wedge-shaped piece involves first locating the center back of the cover, then draping the cover over the wedge and pulling the fabric down so that it touches the floor evenly on all four sides. The center front of the cover should line up with the center front of the wedge-shaped piece, and a mark on the cover is provided for that purpose. Next, the side panels are adjusted to line up with the sides of the wedge-shaped piece and the body width is adjusted towards the center and tucked. Any excess fabric in the front can be tucked behind the front ruffle (skirt). Following this the inside (or hidden) ties are adjusted and tied to the visible ties on the side. The back ties are then adjusted to pull the ruffle (or skirt) tighter and smooth out the fabric to a clean fit.

Installation of the slip cover for a side sofa piece involves first applying either the left or right arm piece as appropriate. The ties are used to pull the fabric taught and to secure the piece to the furniture legs, front and rear. It may happen that the arm piece cover does not reach the floor, but the wrap skirt will completely cover the support portion of the piece. Next, the center back of the cover is located and the cover is draped over the sofa piece, aligned with center of the sofa piece. The side panels are adjusted as was done with the wedge cover. The front seam is now tucked into the seat cushion and the side is tucked into the nearest arm. Any excess fabric in the front can be tucked behind the front skirt. Following this the inside and outside ties are adjusted and tied to each other and then the back ties are tied pulling the skirt taught about the periphery of the piece.

Although the present invention has been described in considerable detail with reference to certain preferred versions thereof, other versions are possible. Therefore, the spirit and scope of the appended claims should not be limited to the description of the preferred versions contained herein.

What is claimed is:

1. A slip cover for a sofa or a love seat, the sofa or love seat including a back portion, a seating surface and a supporting portion provided below the seating surface, the slip cover comprising:

a body piece that includes a generally rectangular back piece and left and right side pieces formed and joined to fit front-facing and back-facing portions of the back piece, each side piece meeting the front-facing portion of the back piece to form a releasably closable vent therebetween on one of a left side or a right side of the sofa or love seat;

a generally rectangular back ruffle piece having a plurality of ties, the back ruffle piece joined by a seam to the back-facing portion of the body piece to cover the supporting portion of the sofa or love seat about a back side and the left and right sides of the sofa or love seat, and having first binding extensions extending at each of left and right ends of the back ruffle piece from the seam of the body piece;

a seat piece joined to the body piece such that side portions of the seat piece can overhang sides of the seating surface of the sofa or love seat to fit a range of seating surface sizes; and a generally rectangular front ruffle piece having a plurality of ties, the front ruffle piece joined by a seam to a front-facing portion of the seat piece to cover the supporting portion of the sofa or love seat about a front side and the left and right sides of the sofa or love seat, and having second binding extensions extending at the left and right ends from the seam;

wherein each releasably closable vent on one of the left side and the right side of the sofa or love seat is configured to be open when the sofa or love seat has an arm on the one side, in order to accommodate the arm of the sofa or love seat, and is configured to be closed when the sofa or love seat has no arm on the one side, wherein the front and back ruffle pieces are unattached to and configured to directly overlap the side portion of the seat piece on the one side when the sofa or love seat has no arm on the one side, and wherein the ties and the first and second binding extensions are tied to one another along the left and right sides of the supporting portion of the sofa or love seat, so as to adjustably wrap the front and back ruffles around the periphery of the sofa or love seat, thereby directly covering excess fabric of the side portion of the seat piece on the one side to adjust the shape of the seat piece when the sofa or love seat has no arm on the one side.

2. The slip cover of claim 1, further comprising:

a first arm piece separate from and not directly joined to any of the body piece, back ruffle piece and seat piece, wherein the sofa or love seat has the arm on the one side, wherein the arm piece is configured to cover the arm on the one side, wherein the front and back ruffle pieces are unattached to and are configured to directly overlap a side portion of the arm piece of the slip cover on the one side, and wherein the front and back ruffles are configured to directly cover excess fabric of the arm piece on the one side to adjust the shape of the arm piece.

3. The slip cover of claim 2, wherein the arm piece comprises at least one tie or binding extension for securing the arm piece to the sofa or love seat.

4. The slip cover of claim 2, wherein the sofa or love seat further includes a second arm on the other of the left side or right side, the slip cover further comprising:

a second arm piece separate from and not directly joined to any of the body piece, back ruffle piece and seat piece, and wherein the arm piece is configured to cover the second arm on the other side.

5. A slip cover for a sofa or a love seat, the sofa or love seat including a back portion, a seating surface and a supporting portion, the slip cover comprising:

means for covering the back portion, the back portion covering means including left and right vents, each of the left and right vents configured to be closed by securely joining a vent facing piece on one side of the vent with a vent facing piece on another side of the vent and to be opened by separating the vent facing piece on the one side of the vent from a vent facing piece on the other side of the vent, each opened vent further configured to accommodate an arm of the sofa or love seat being positioned therethrough;

means, connected to the back portion covering means, for adjustably covering the seating surface having a range of seating surface shapes and sizes; and means, connected to the back portion covering means and the seating surface covering means, for adjustably covering the supporting portion about the periphery of the sofa or love seat.

6. A slip cover as recited in claim 5, further comprising means for covering the arm extending through one of the vents.

7. A slipcover as recited in claim 5, wherein at least one of the left and right vents is closed by securing means securing the vent facing pieces on each side of the at least one vent.

8. A slipcover as recited in claim 7, wherein the securing means comprises a hook and loop fastening system attached to each of the vent facing pieces on each side of the at least one vent.

9. A slip cover for a sofa or a love seat, the sofa or love seat including a back, a seating surface and a supporting portion, the slip cover comprising:

a generally rectangular back piece for covering the back, the back piece having front and back edges and left and right side edges and having left and right vent facings attached to frontward-facing portions of the left and right side edges, respectively;

left and right side pieces for covering the sides of the back portion, each piece having attached thereto a vent facing, the left side piece being joined to the left side edge of the back portion so as to align the vent facing of the left side piece with the left vent facing of the back piece such that a left vent is formed therebetween along the frontward-facing portion of the left side edge, the left vent being closable by securely joining the vent facing of the left side piece with the left vent facing of the back piece, the right side piece being joined to the right side of the back portion so as to align the vent facing of the right side piece with the right vent facing of the back piece such that a right vent is formed therebetween along the frontward-facing portion of the right side edge, the right vent being closable by securely joining the vent facing of the right side piece with the right vent facing of the back piece;

a generally rectangular back ruffle piece having a plurality of ties, the back ruffle piece having a long side joined by a seam to the back edge of the back piece and side pieces to cover the supporting portion of the sofa or love seat about the back and sides, and having first binding extensions extending at the left and right ends from the seam of the back ruffle piece;

a seat piece having a back edge longer than the front edge of the back piece, the back edge of the seat piece being joined to the front edge of the back piece such that side portions of the seat piece can overhang the sides of the seating surface of the sofa or love seat to fit a range of seating surface sizes; and a generally rectangular front ruffle piece having a plurality of ties, the front ruffle piece having a long edge joined by a seam to a front edge of the seat piece to cover the supporting portion of the sofa or love seat about the front and sides, and having second binding extensions extending at the left and right ends from the seam;

wherein the front and back ruffle pieces overlap, with the ties and the first and second binding extensions tied to one another, so as to adjustably wrap the front and back ruffles around the periphery of the sofa or love seat, covering any overhanging side portions of the seat piece.

10. A slip cover as recited in claim 9, wherein the front ruffle piece is formed from a single piece of material.

11. A slip cover as recited in claim 9, wherein the front ruffle piece is formed from two side ruffle pieces, two recliner front pieces, and a center ruffle; and wherein the front recliner pieces are joined so as to overlap the center piece, and such that the side ruffle pieces are partially under the front recliner pieces.

12. A slip cover as recited in claim 11, wherein the sofa or love seat has a recliner function.

13. A slip cover as recited in claim 9, further comprising an arm piece for covering a left or right arm of the sofa or love seat, the arm piece including two binding extensions for securing the arm piece to a front and a back leg of the sofa or love seat.

14. A slip cover as recited in claim 9, wherein the seam between the front ruffle and seat piece and the seam between the back ruffle and back piece are finished with a chain stitched bias binding that permits the ruffles to stretch tightly around the periphery of the sofa or love seat.

15. A slip cover as recited in claim 9, wherein the seat piece is adapted to cover a T-cushion shape.

16. A slip cover as recited in claim 9, wherein the seat piece is adapted to cover a standard cushion shape.

17. A slip cover as recited in claim 9, wherein the slip cover is adapted to cover a medium-sized sofa; and wherein the back piece and side pieces are adapted to fit a back portion having a width variance of approximately 6 inches.

18. A slip cover as recited in claim 9, wherein the slip cover is adapted to cover a large-sized sofa; and wherein the back piece and side pieces are adapted to fit a back portion having a width variance of approximately 15 inches.

19. A slip cover as recited in claim 9, wherein the slip cover is adapted to cover a medium-sized sofa; and wherein the seat piece is adapted to fit a seating surface having a width variance of approximately 6 inches.

20. A slip cover as recited in claim 9, wherein the slip cover is adapted to cover a large-sized sofa; and wherein the seat piece is adapted to fit a seating surface having a width variance of approximately 15 inches.

21. A slip cover as recited in claim 9, wherein the slip cover is adapted to fit a medium-sized sofa; and wherein the back piece is adapted to fit a back portion having an inside contour variance of approximately 10 inches.

22. A slip cover as recited in claim 9, wherein the slip cover is adapted to fit a large-sized sofa; and wherein the back piece is adapted to fit a back portion having an inside contour variance of approximately 10 inches.

* * * * *